US009434567B2

(12) United States Patent
Arakane

(10) Patent No.: US 9,434,567 B2
(45) Date of Patent: Sep. 6, 2016

(54) INKJET PRINTER, SHEET DISCRIMINATING DEVICE AND INKJET PRINTING METHOD

(71) Applicant: BROTHER KOGYO KABUSHIKI KAISHA, Nagoya, Aichi (JP)

(72) Inventor: Satoru Arakane, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/600,208

(22) Filed: Jan. 20, 2015

(65) Prior Publication Data

US 2015/0202903 A1 Jul. 23, 2015

(30) Foreign Application Priority Data

Jan. 20, 2014 (JP) ..... 2014-007725

(51) Int. Cl.

| | |
|---|---|
| ***B41J 25/304*** | (2006.01) |
| ***B65H 7/20*** | (2006.01) |
| ***B65H 7/02*** | (2006.01) |
| ***B65H 29/70*** | (2006.01) |
| ***B41J 2/21*** | (2006.01) |

(Continued)

(52) U.S. Cl.

CPC ..... *B65H 29/70* (2013.01); *B41J 2/2135* (2013.01); *B41J 11/0095* (2013.01); *B41J 19/142* (2013.01)

(58) Field of Classification Search

CPC ..... B32B 29/08; B31F 1/12; B65H 7/02; B65H 7/20; B65H 9/00; B65H 29/70; B41J 25/304

See application file for complete search history.

(56) References Cited

U.S. PATENT DOCUMENTS

| | | | |
|---|---|---|---|
| 5,874,979 | A | 2/1999 | Ohyama |
| 6,471,315 | B1 | 10/2002 | Kurata |
| 7,237,858 | B2 | 7/2007 | Igarashi |

(Continued)

FOREIGN PATENT DOCUMENTS

| | | | |
|---|---|---|---|
| JP | HEI 05-155009 | A | 6/1993 |
| JP | H09-48161 | A | 2/1997 |

(Continued)

OTHER PUBLICATIONS

U.S. Office Action dated Mar. 20, 2015 issued in U.S. Appl. No. 14/158,000.

(Continued)

*Primary Examiner* — Matthew Luu
*Assistant Examiner* — Patrick King
(74) *Attorney, Agent, or Firm* — Scully Scott Murphy and Presser

(57) ABSTRACT

In an inkjet printer, a controller is configured to calculate, during movement of a carriage in a scanning direction, a signal level difference between a first detection signal in a mountain peak zone including an assumed mountain peak position and the first detection signal in a valley bottom zone including an assumed valley bottom position identified, based on information stored in a storage, and alternately execute, during the movement of the carriage, an ejection process of ejecting ink drops, and a conveying process of conveying the sheet by a predetermined line feed width. In the printing process, the printing head and the conveyor are driven according to a first condition when the signal level difference is equal to or larger than a threshold value, while driven according to a second condition when the signal level difference is less than the threshold value.

8 Claims, 12 Drawing Sheets

(51) Int. Cl.

| | |
|---|---|
| ***B41J 19/14*** | (2006.01) |
| ***B41J 11/00*** | (2006.01) |

(56) References Cited

U.S. PATENT DOCUMENTS

| | | | | |
|---|---|---|---|---|
| 8,567,905 | B2 | 10/2013 | Ogasawara | |
| 2004/0126164 | A1 | 7/2004 | Ohyama | |
| 2005/0088471 | A1* | 4/2005 | Endo | B41J 11/0065 347/16 |
| 2007/0291056 | A1 | 12/2007 | Tanahashi et al. | |
| 2009/0219322 | A1 | 9/2009 | Terada | |
| 2009/0262157 | A1* | 10/2009 | Sato | B41J 11/008 347/14 |
| 2010/0039473 | A1* | 2/2010 | Terada | B41J 11/0095 347/19 |
| 2010/0244357 | A1 | 9/2010 | Takahata | |
| 2011/0063352 | A1 | 3/2011 | Sakurada et al. | |
| 2011/0157269 | A1 | 6/2011 | Teramae | |
| 2011/0175958 | A1* | 7/2011 | Sato | B41J 19/142 347/14 |
| 2011/0298854 | A1 | 12/2011 | Sakurada et al. | |
| 2012/0050406 | A1* | 3/2012 | Ogasawara | B41J 11/005 347/37 |
| 2013/0257939 | A1* | 10/2013 | Arakane | B41J 2/04556 347/8 |
| 2014/0168300 | A1 | 6/2014 | Kubo et al. | |
| 2014/0204141 | A1 | 7/2014 | Arakane | |

FOREIGN PATENT DOCUMENTS

| | | | |
|---|---|---|---|
| JP | HEI 11-240146 | A | 9/1999 |
| JP | 2003-251800 | A | 9/2003 |
| JP | 2004-017586 | A | 1/2004 |
| JP | 2004-106978 | A | 4/2004 |
| JP | 2005-246642 | A | 9/2005 |
| JP | 2006-102997 | A | 4/2006 |
| JP | 2006-192636 | A | 7/2006 |
| JP | 2007-144718 | A | 6/2007 |
| JP | 2007-331297 | A | 12/2007 |
| JP | 2007-331315 | A | 12/2007 |
| JP | 2008-221729 | A | 9/2008 |
| JP | 2009-128822 | A | 6/2009 |
| JP | 2009-143152 | A | 7/2009 |
| JP | 2009-196367 | A | 9/2009 |
| JP | 2009-202430 | A | 9/2009 |
| JP | 2009-208273 | A | 9/2009 |
| JP | 2010-042646 | A | 2/2010 |
| JP | 2011-079296 | A | 4/2011 |
| JP | 2011-148123 | A | 8/2011 |
| JP | 2014-136419 | A | 7/2014 |
| JP | 2014-139002 | A | 7/2014 |

OTHER PUBLICATIONS

Notice of Allowance dated Mar. 20, 2015 issued in U.S. Appl. No. 14/341,015.

Notice of Allowance dated Mar. 5, 2015 issued in U.S. Appl. No. 14/341,080.

Notice of Allowance dated Feb. 11, 2015 issued in U.S. Appl. No. 14/107,035.

U.S. Office Action dated Sep. 4, 2014 received in related U.S. Patent Application, namely U.S. Appl. No. 14/107,035.

U.S. Office Action dated Nov. 19, 2014 received in related U.S. Patent Application, namely U.S. Appl. No. 14/341,015.

U.S. Office Action dated Dec. 24, 2014 received in related U.S. Patent Application, namely U.S. Appl. No. 14/158,000.

U.S. Patent Application filed Jul. 25, 2014, namely U.S. Appl. No. 14/341,015.

U.S. Patent Application filed Jul. 25, 2014, namely U.S. Appl. No. 14/341,080.

U.S. Office Action dated Nov. 20, 2014 received in related U.S. Patent Application, namely U.S. Appl. No. 14/341,080.

U.S. Office Action dated Aug. 10, 2015 issued in U.S. Appl. No. 14/158,000.

U.S. Office Action dated Dec. 24, 2015 issued in U.S. Appl. No. 14/158,000.

Japanese Office Action dated Feb. 9, 2016 received in responding Japanese Patent Application No. 2013-007643.

* cited by examiner

| ASSUMED MOUNTAIN PEAK POSITION/ ASSUMED VALLEY BOTTOM POSITION | P1 | P2 | P3 | P4 | P5 | P6 | P7 | P8 | P9 | P10 | P11 | P12 | P13 | P14 | P15 | P16 | P17 |
|---|---|---|---|---|---|---|---|---|---|---|---|---|---|---|---|---|---|
| CARRIAGE SENSOR VALUE | E1 | E2 | E3 | E4 | E5 | E6 | E7 | E8 | E9 | E10 | E11 | E12 | E13 | E14 | E15 | E16 | E17 |
| FIRST EJECTION TIMING COMPENSATION VALUE | X1 | X2 | X3 | X4 | X5 | X6 | X7 | X8 | X9 | X10 | X11 | X12 | X13 | X14 | X15 | X16 | X17 |
| SECOND EJECTION TIMING COMPENSATION VALUE | Y1 | Y2 | Y3 | Y4 | Y5 | Y6 | Y7 | Y8 | Y9 | Y10 | Y11 | Y12 | Y13 | Y14 | Y15 | Y16 | Y17 |
| MEDIUM SENSOR VALUE | | | | | | | | | | | | | | | | | |

FIG. 6

INKJET PRINTER, SHEET DISCRIMINATING DEVICE AND INKJET PRINTING METHOD

This application claims priority under 35 U.S.C. §119 from Japanese Patent Application No. 2014-007725 filed on Jan. 20, 2014. The entire subject matter of the application is incorporated herein by reference.

BACKGROUND

1. Technical Field

The present disclosures relate to an inkjet printer, a sheet discriminating device and an inkjet printing method.

2. Related Art

Conventionally, inkjet printers configured to eject ink drops to form an image on a sheet have been known. Among such inkjet printers, one having a platen having a patterned indented surface and a sheet holding plate arranged to face the platen is known. In such an inkjet printer, by the indented surface of the platen and the sheet holding plate, the sheet is formed to have a corrugated shape in a scanning direction, which is a transverse direction with respect to a sheet conveying direction.

SUMMARY

Degree of corrugation of the corrugated shape of the sheet may be different depending on directions of fibers of the sheet. Therefore, if an image is formed without taking a direction of the fibers of the sheet with respect to the scanning direction, quality of the image may be deteriorated.

In consideration of the above, aspects of the disclosure provide a technique which is capable of suppressing deterioration of an image quality due to the difference of the direction of the fibers of the sheets.

According to aspects of the disclosures, there is provided an inkjet printer, which is provided with a sheet conveyor configured to convey a sheet in a conveying direction, a printing head configured to eject ink drops on the sheet conveyed by the sheet conveyor, a first sensor which is a reflective sensor configured to output a first detection signal corresponding to a received amount of reflected light, a carriage mounting the printing head and the first sensor thereon and configured to move in a scanning direction which intersects with the conveying direction, a second sensor configured to output a second signal corresponding to a location of the carriage in the scanning direction, a corrugation forming mechanism configured to form the sheet to have a corrugated shape so as to have mountain peak positions and valley bottom positions which are alternately arranged in the scanning direction at a portion facing the printing head, the sheet being deformed toward the printing head at the mountain peak positions and deformed away from the printing head at the valley bottom positions, a storage configured to store information representing the second detection signals at a plurality of assumed mountain peak positions which are assumed to be positions at which the first sensor faces the mountain peak positions of the sheet, and information representing the second detection signals at a plurality of assumed valley bottom positions which are assumed to be positions at which the first sensor faces the valley bottom positions of the sheet, and a controller. In such an inkjet printer, the controller is configured to execute a calculation process in which the controller calculates, during movement of the carriage in the scanning direction, a signal level difference, which is a difference between the first detection signal in the mountain peak zone including the assumed mountain peak position that is identified based on the information stored in the storage and the first detection signal in the valley bottom zone including the assumed valley bottom position that is identified based on the information stored in the storage, and a printing process in which the controller alternately executes, during the movement of the carriage, an ejection process of causing the printing head to eject ink drops, and a conveying process of causing the conveyor to convey the sheet by a predetermined line feed width. In the printing process, the controller drives the printing head and the conveyor according to a first condition when the signal level difference is equal to or larger than a threshold value, and the controller drives the printing head and the conveyor according to a second condition when the signal level difference is less than the threshold value.

According to further aspects of the disclosures, there is provided a sheet discriminating device, which is provided with a sheet conveyor configured to convey a sheet in a conveying direction, a first sensor which is movable in an intersecting direction which direction intersecting with the conveying direction, the first sensor being a reflective sensor configured to output a first detection signal corresponding to a received amount of reflected light, a second sensor configured to output a second signal corresponding to a location of the carriage in the intersecting direction, a corrugation forming mechanism configured to form the sheet to have a corrugated shape so as to have mountain peak positions and valley bottom positions which are alternately arranged in the scanning direction at a portion facing the printing head, the sheet being deformed toward the first sensor at the mountain peak positions and deformed away from the first sensor at the valley bottom positions, a storage configured to store information representing the second detection signals at a plurality of assumed mountain peak positions which are assumed to be positions at which the first sensor faces the mountain peak positions of the sheet, and information representing the second detection signals at a plurality of assumed valley bottom positions which are assumed to be positions at which the first sensor faces the valley bottom positions of the sheet, and a controller. In such a sheet discrimination device, the controller is configured to execute an information obtaining process in which the controller obtains direction information representing whether a longer dimension of the sheet conveyed by the conveyor is aligned with the conveying direction or the intersecting direction, a calculation process in which the controller calculates, during movement of the first sensor in the intersecting direction, a signal level difference, which is a difference between the first detection signal in the mountain peak zone including the assumed mountain peak position that is identified based on the information stored in the storage and the first detection signal in the valley bottom zone including the assumed valley bottom position that is identified based on the information stored in the storage, and a discriminating process in which the controller discriminates whether the sheet is conveyed in a grain direction or a cross-grain direction based on a combination of the direction information and the signal level difference.

According to furthermore aspects of the disclosure, there is provided a method of printing an image on a sheet employed in an inkjet printer. The inkjet printer may be provided with a sheet conveyor configured to convey a sheet in a conveying direction, a printing head configured to eject ink drops on the sheet conveyed by the sheet conveyor, a first sensor which is a reflective sensor configured to output a first detection signal corresponding to a received amount of reflected light, a carriage mounting the printing head and the first sensor thereon and configured to move in a scanning direction which intersects with the conveying direction, a second sensor configured to output a second signal corresponding to a location of the carriage in the scanning direction, a corrugation forming mechanism configured to form the sheet to have a corrugated shape so as to have mountain peak positions and valley bottom positions which are alternately arranged in the scanning direction at a portion facing the printing head, the sheet being deformed toward the printing head at the mountain peak positions and deformed away from the printing head at the valley bottom positions, and a storage configured to store information representing the second detection signals at a plurality of assumed mountain peak positions which are assumed to be positions at which the first sensor faces the mountain peak positions of the sheet, and information representing the second detection signals at a plurality of assumed valley bottom positions which are assumed to be positions at which the first sensor faces the valley bottom positions of the sheet. The method includes calculating, during movement of the carriage in the scanning direction, a signal level difference, which is a difference between the first detection signal in the mountain peak zone including the assumed mountain peak position that is identified based on the information stored in the storage and the first detection signal in the valley bottom zone including the assumed valley bottom position that is identified based on the information stored in the storage, and printing by alternately executing, during the movement of the carriage, an ejection step of causing the printing head to eject ink drops, and a conveying step of causing the conveyor to convey the sheet by a predetermined line feed width. The step of printing may include driving the printing head and the conveyor according to a first condition when the signal level difference is equal to or larger than a threshold value, and driving the printing head and the conveyor according to a second condition when the signal level difference is less than the threshold value.

BRIEF DESCRIPTION OF THE ACCOMPANYING DRAWINGS

FIG. 6 schematically shows an example of information stored in an EEPROM (electrically erasable read only memory).

Figure 7:
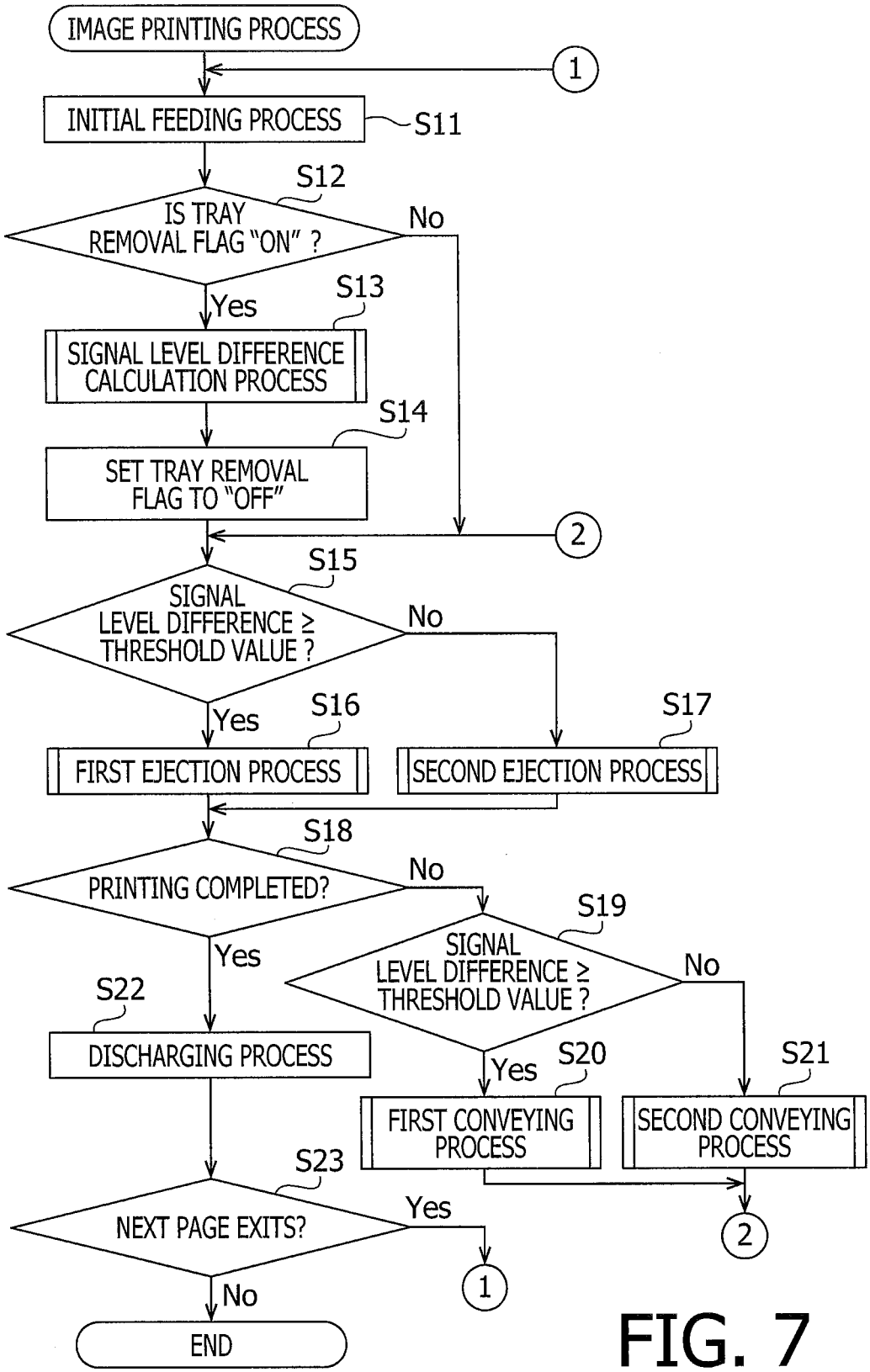

FIG. 7 is a flowchart illustrating an image printing process according to aspects of the disclosures.

Figure 8:
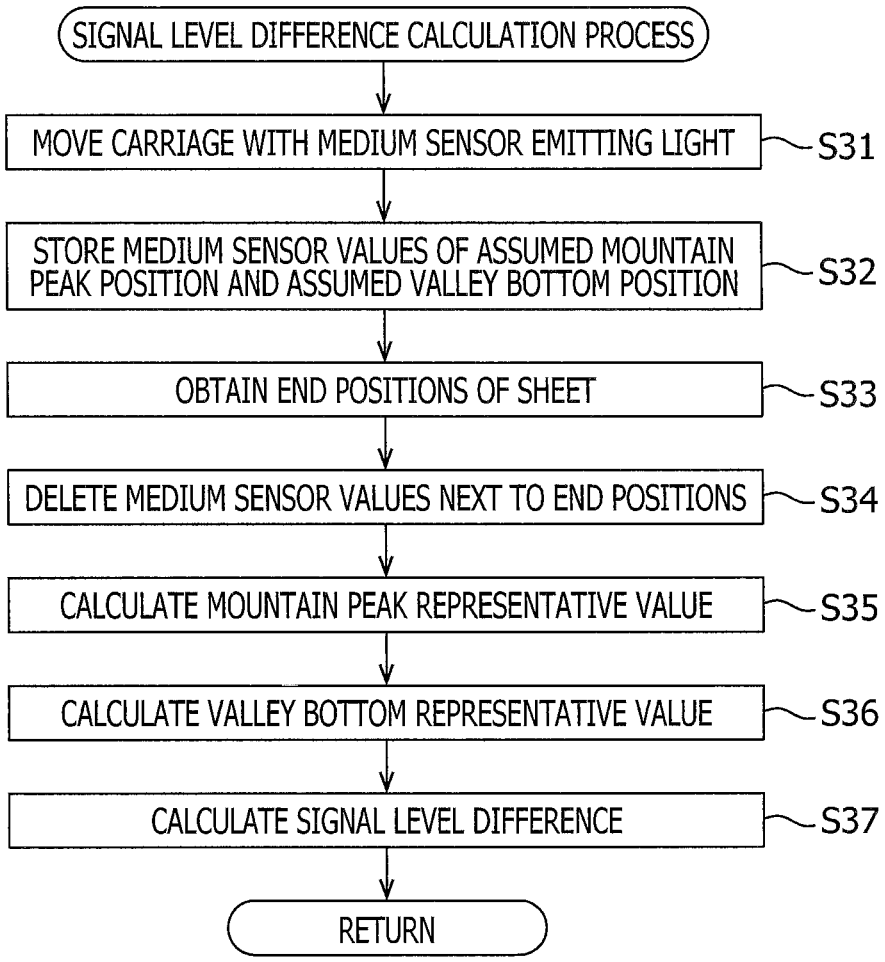

FIG. 8 is a flowchart illustrating a signal level difference calculation process according to aspects of the disclosures.

Figure 9B:
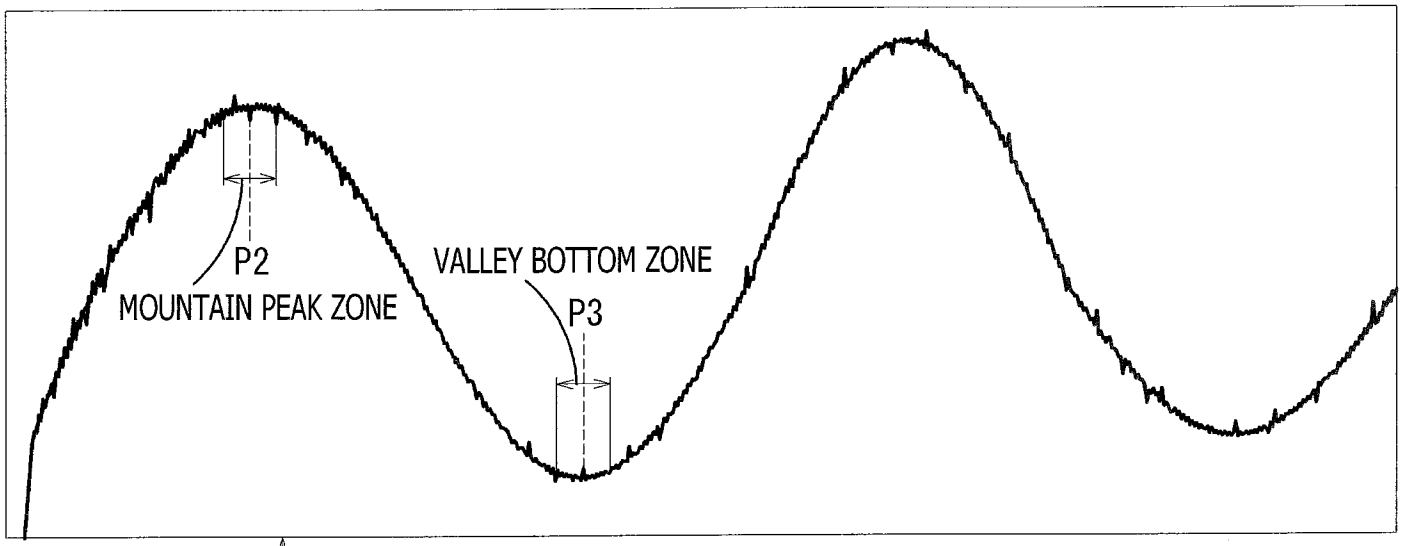
Figure 9A:
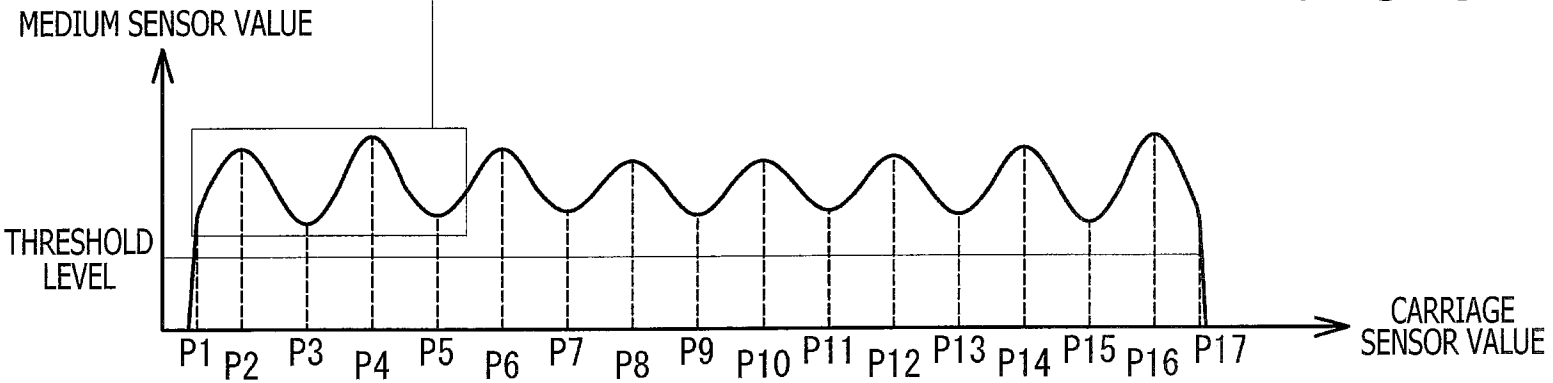

FIGS. 9A and 9B show an example of a detection signal output from a medium sensor and a partially enlarged view thereof, respectively.

Figure 10:
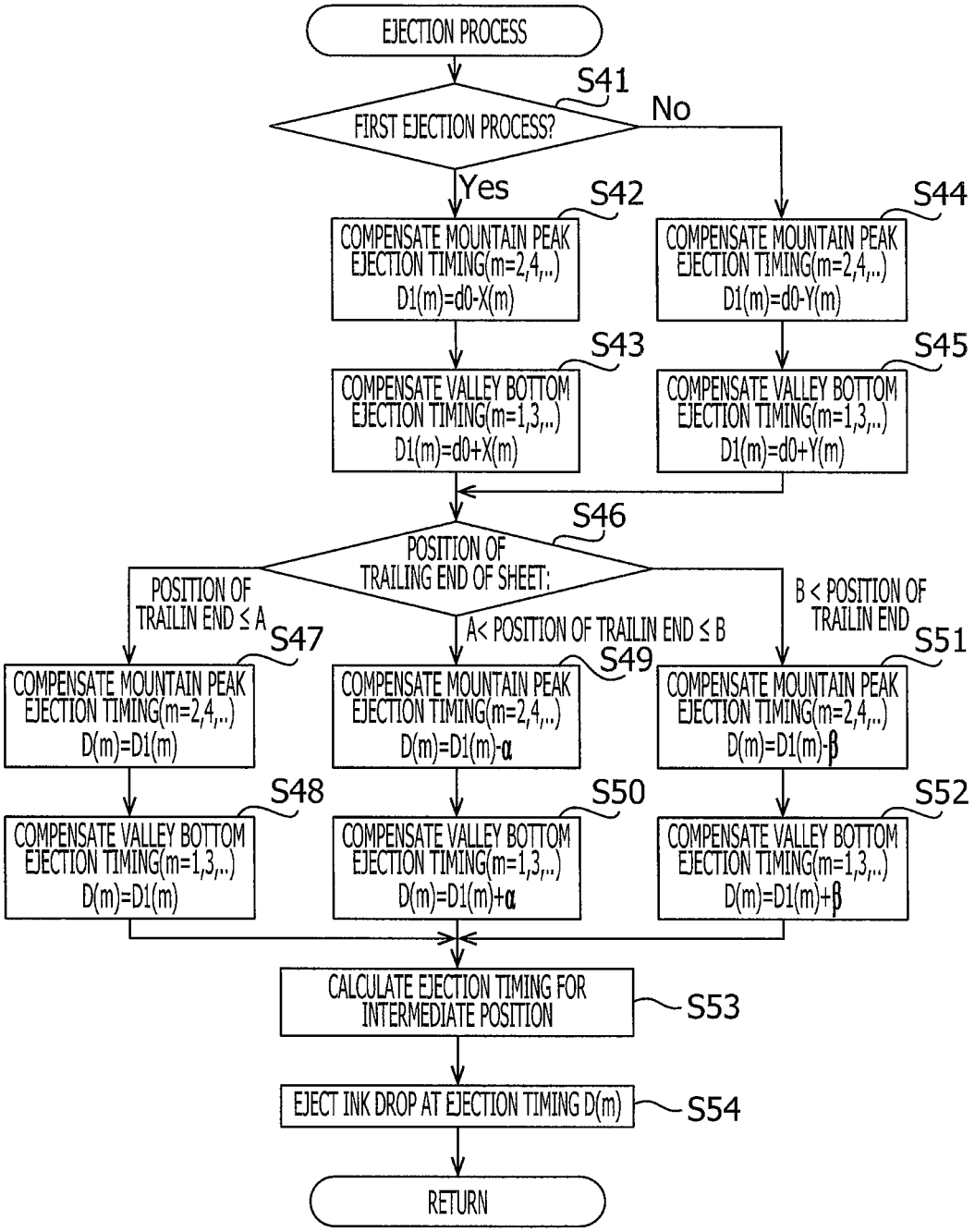

FIG. 10 is a flowchart illustrating an ejection process according to aspects of the disclosures.

Figure 11:
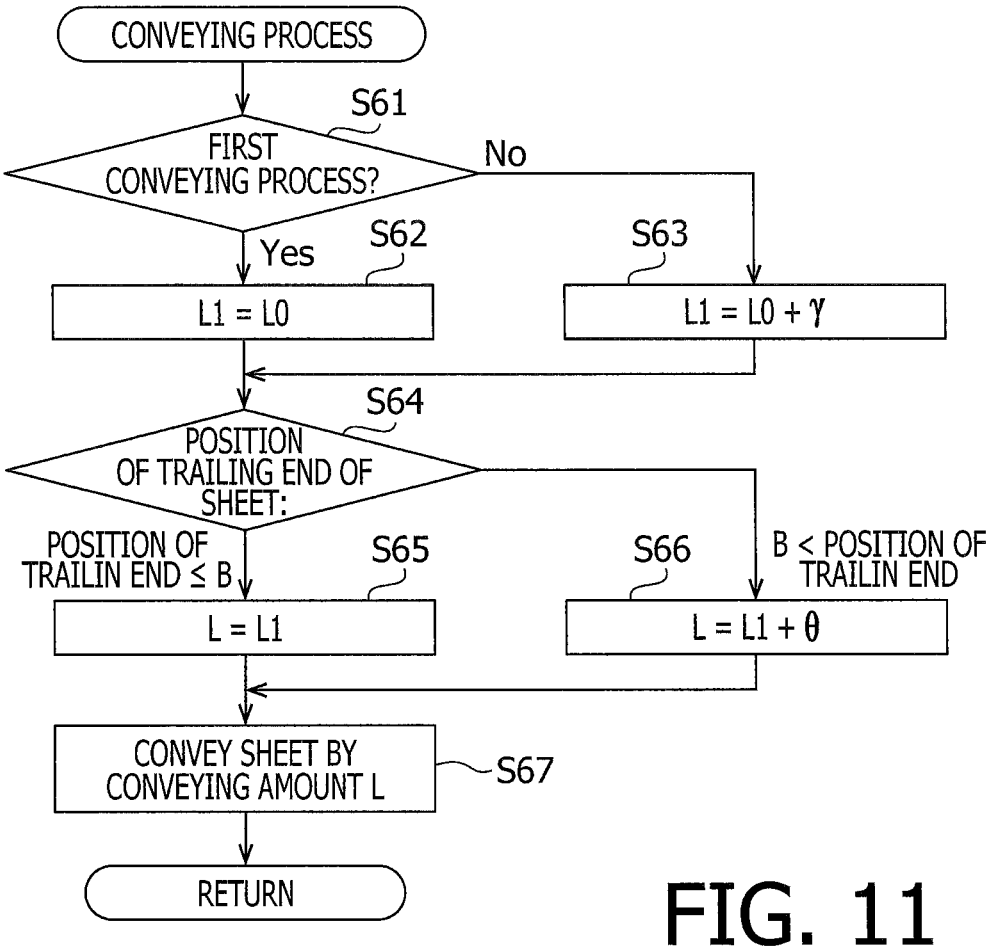

FIG. 11 is a flowchart illustrating a conveying process according to aspects of the disclosures.

Figure 12:
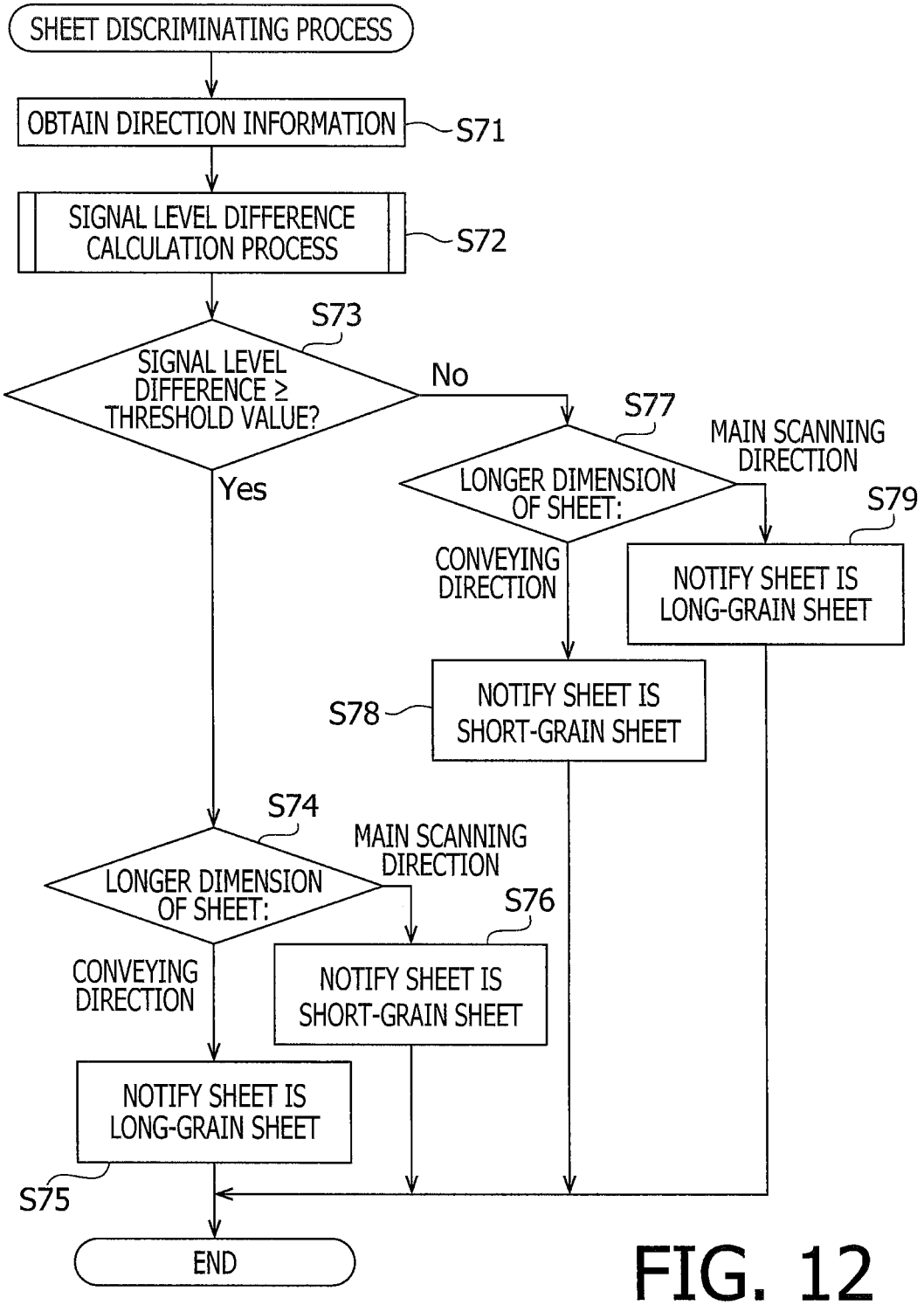

FIG. 12 is a flowchart illustrating a sheet discriminating process according to aspects of the disclosures.

DETAILED DESCRIPTION OF THE EMBODIMENT

Hereinafter, referring to the accompanying drawings, an illustrative embodiment according to aspects of the disclosures will be provided. It should be noted that the illustrative embodiment described hereinafter is merely an example and various modification may be realized without departing from the aspects of the disclosures.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Figure 1:
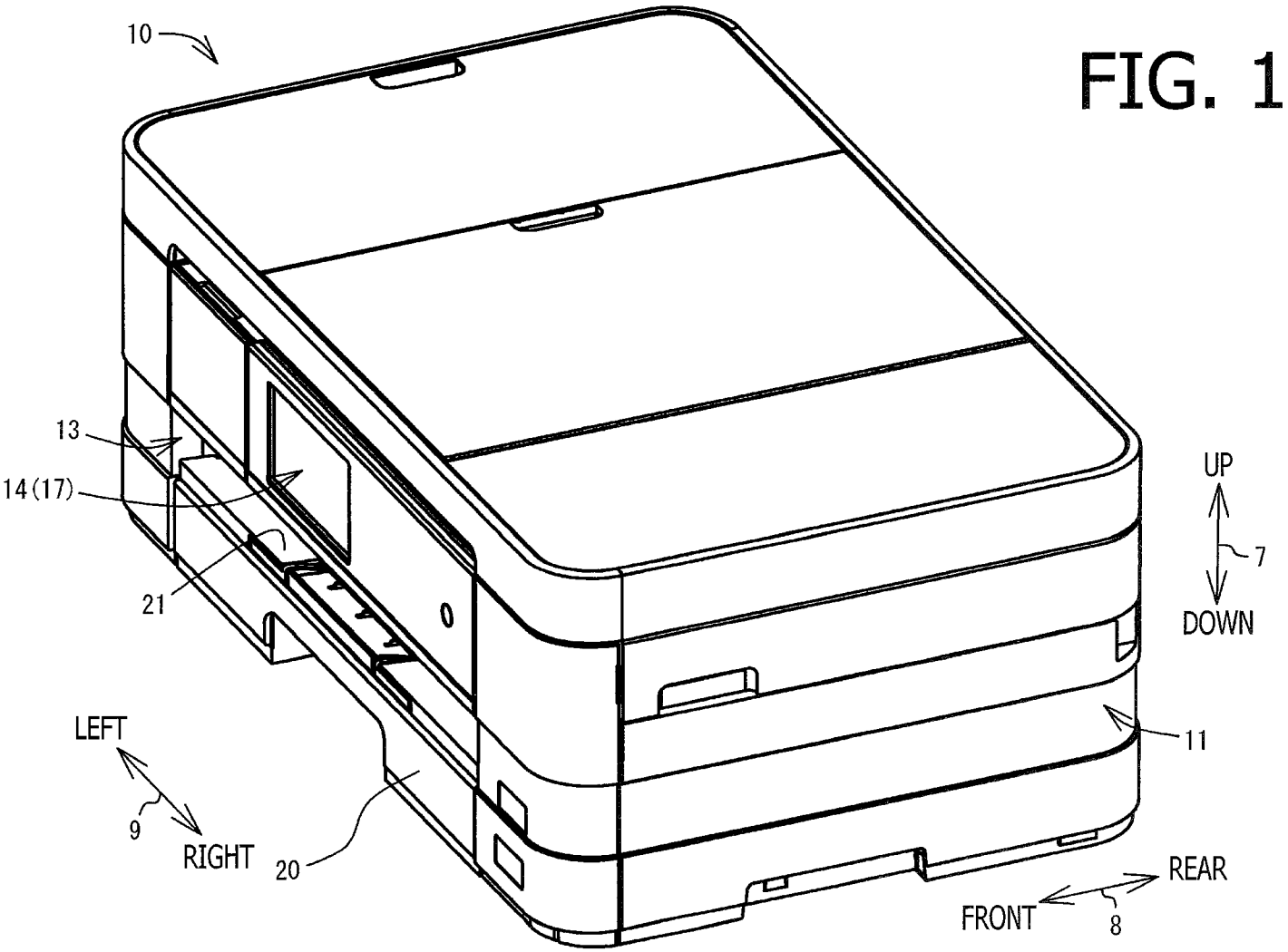
FIG. 1 is a perspective view of a multi-function peripheral according to aspects of the disclosures.

In the following description and drawings, directions will be defined such that up and down directions are defined with respect an MFP (multi-function peripheral) 10 placed for use as shown in FIG. 1. Further, a direction on which an opening 13 is formed on a casing of the MFP 10 is defined as a front side of the MFP 10, an opposite side is defined as a rear side, and right and left sides when the MFP 10 is viewed from the front side are defined as right and left sides of the MFP 10, respectively. In the following description, an up-and-down direction 7, a front-and-rear direction 8 and a right-and-left direction 9 are defined based on the above definitions.

The MFP 10 has a substantially cuboids outer shape as shown in FIG. 1. The MFP 10 has a printer unit 11 provided on a lower part thereof. The printer unit 11 is configured to print images on sheets 12 in accordance with an inkjet printing method. Specifically, the printer unit 11 conveys the sheet 12 and ejects ink drops on the sheet being conveyed, thereby printing an image on the sheet 12. The printer unit 11 is, as shown in FIG. 2, provided with a feeding unit 14, a feeding tray 20, a discharging tray 21, a conveying roller unit 54, a printing unit 24, a discharging roller unit 55, a platen 42, and multiple contacting members 80 (see FIG. 4).

As shown in FIG. 1, an opening 13 is formed on the front surface of the printer unit 11, and the feeding tray 20 is configured to be slidably attached to and removed from the printer unit 11 through the opening 13 by a user. The feeding tray 20 is configured to support a plurality of sheets 12 which are to be fed to a conveying path 65 by the feeding unit 15. The discharging tray 21 is arranged above the feeding tray 20. The discharging tray 21 supports the sheets 12 discharged by the discharging roller unit 55.

Figure 2:
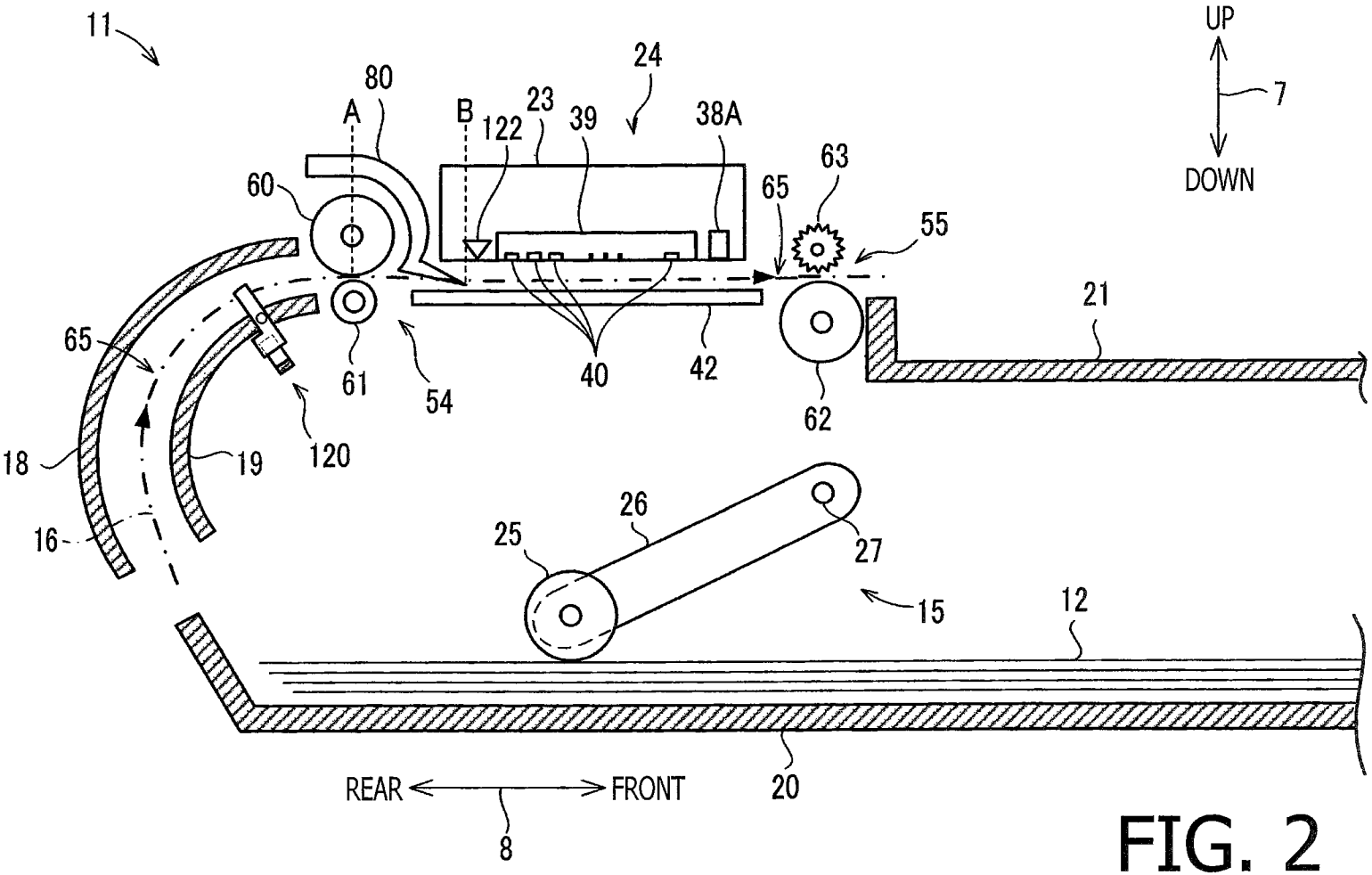
FIG. 2 is a cross-sectional side view schematically showing main components in a printer unit of the multi-function peripheral according to aspects of the disclosures.

The feeding unit 15 is, as shown in FIG. 2, provided with a feeding roller 25, a feeding arm 26 and a shaft 27. The feeding roller 25 is rotatably supported at a tip end of the feeding arm 26. The feeding roller 25 is driven to rotate in a direction where the sheet 12 is fed in the conveying direction 16 as a conveying motor 102 (see FIG. 5) is reversely rotated. The feeding arm 26 is rotatably supported by the shaft 27, while rotatably urged toward the feeding tray 20.

The conveying path 65 is a space, a part of which is defined by an outer guide member 18 and an inner guide member 19, which face each other with a predetermined distance therebetween, inside the printer unit 11 as shown in FIG. 2. The conveying path 65 extends from a rear end portion of the feeding tray 20 toward the rear end portion of the printing unit 24. The conveying path 65 is formed to make a U-turn at the rear end portion of the printer unit 11 from a lower side to an upper side, and further extends toward the discharging tray 21 via the printing unit 24. A conveying direction 16 of the sheet 12 inside the conveying path 65 is indicated by a dotted line in FIG. 2.

The conveying roller unit 54 is arranged on an upstream side, in the conveying direction 16, with respect to the printing unit 24 as shown in FIG. 2. The conveying roller unit 54 is provided with a conveying roller 60 and a pinch roller 61, which face each other. The conveying roller 60 is driven by a conveying motor 102 to rotate. The pinch roller 61 is driven by rotation of the conveying roller 60 to rotate. When the conveying motor 102 forwardly rotates, the sheet 12 nipped between the rotating conveying roller 60 and the pinch roller 61 is conveyed in the conveying direction 16.

The discharging roller unit 55 is arranged on a downstream side, in the conveying direction 16, with respect to the printing unit 24 as shown in FIG. 2. The discharging roller unit 55 is provided with a discharging roller 62 and a spur roller 63, which face each other. The discharging roller 62 is driven by the conveying motor 102 to rotate. The spur roller 63 is driven by rotation of the discharging roller 62 to rotate. The sheet 12 nipped between the discharging roller 62 and the spur roller 63 is conveyed in the conveying direction 16 as the conveying motor 102 rotates forwardly.

The printer unit 11 is provided with a registration sensor 120 on the upstream side, in the conveying direction 16, with respect to the conveying roller unit 54. The registration sensor 120 is configured to output a low level signal, which is a detection signal, to a controller 130 (described later) in response to presence of the sheet 12 at a detection position, which is a position where the registration sensor 120 is arranged. The registration sensor 120 is also configured to output a high level signal, which is also a detection signal, in response to absence of the sheet 12 at the detection position, to the controller 130.

The printer unit 11 is provided with a well-known rotary encoder 121 (see FIG. 5) configured to output a pulse signal in synchronization with a rotation of the conveying roller 60. The rotary encoder 121 is provided with an encoding disc and an optical sensor. The encoder disc is configured to rotate together with the conveying roller 60, while the optical sensor reads a predetermined pattern formed on the encoder disc and generates a pulse signal, which is transmitted to the controlling unit 130.

The printing unit 24 is arranged between, in the conveying direction 16, the conveying roller unit 54 and the discharging roller unit 55, as shown in FIG. 2. The printing unit 24 is arranged to face a platen 42 in the up-and-down direction 7. The printing unit 24 is provided with a carriage 23, a printing head 39, an encoder sensor 38A, and a medium sensor 122.

Figure 3:
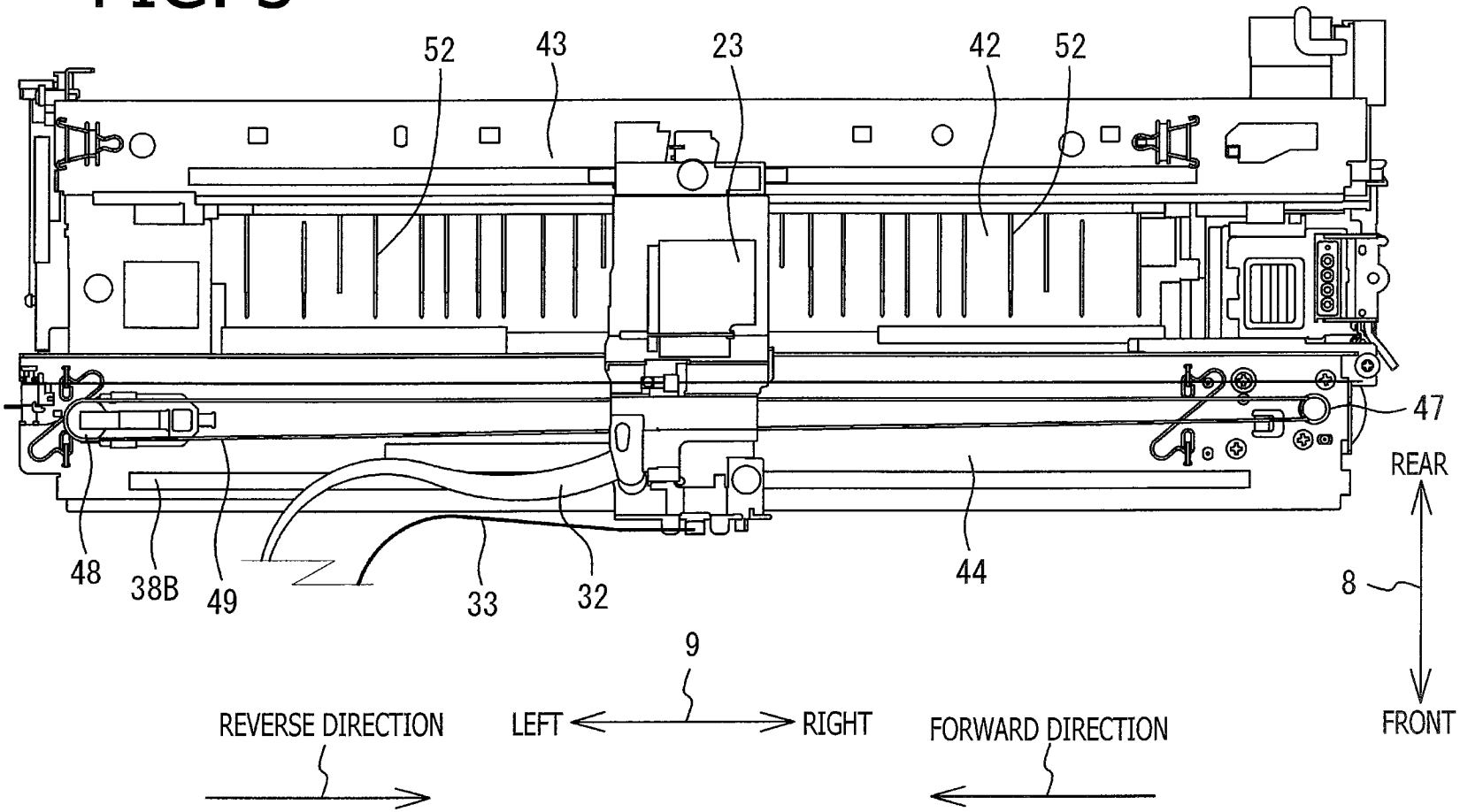
FIG. 3 is a plan view showing a carriage and guide rails of the printer unit according to aspects of the disclosures.

From the carriage 23, an ink tube 32 and a flexible flat cable 33 extend, as shown in FIG. 3. The ink tube 32 is configured to supply ink contained in the ink cartridge to the printing head 39. The flexible flat cable 33 electrically connects the controller substrate on which the controller 130 is arranged with the printing head 39.

The carriage 23 is supported on the guide rails 43 and 44 which are arranged at positions spaced from each other in the front-and-rear direction 8 as shown in FIG. 3. The carriage 23 is connected to a well-known belt mechanism provided to the guide rail 44. The belt mechanism is provided with a driving pulley 47 arranged at an end portion in the right-and-left direction 9, of the guide rail 44, a driven pulley 48 arranged at the other end portion in the right-and-left direction 9, and a belt 49 wound around the driving pulley 47 and the driven pulley 48. The carriage 23 is secured to the belt 49.

As the carriage motor 103 (see FIG. 5) rotates, the driving pulley 47 rotates and causes the belt 49 to perform a round movement. Then, the carriage 23 reciprocally moves in the right-and-left direction 9 (which will also be referred to as a scanning direction). Specifically, when the carriage motor 103 forwardly rotates, the carriage 23 moves in a forward direction, which is a direction directed from the right end to the left end in the right-and-left direction 9 (see FIG. 3). Further, when the motor 103 reversely rotates, the carriage 23 moves in a reverse direction, which is a direction directed from the left end to the right end, in the right-and-left direction 9 (see FIG. 3).

The printing head 39 is mounted on the carriage 23 as shown in FIG. 2. On the lower surface of the printing head 39, a plurality of nozzles 40 are formed. The printing head 39 is configured to eject the ink through the nozzles 40 as minute ink drops. During movement of the carriage 23, the printing head 39 ejects the ink drops onto the sheet 12 supported by the platen 42, thereby an image being printed on the sheet 12.

On the guide rail 44, a belt-like encoder strip 38B is attached as shown in FIG. 3. An encoder sensor 38A (see FIG. 2) is mounted on the carriage 23 so as to face the encoder strip 38B. As the carriage 23 moves, the encoder sensor 38A reads a predetermined pattern formed on the encoder strip 38B to generate a pulse signal, and transmits the pulse signal to the controller 130. The encoder sensor 38A and the encoder strip 38B constitute the carriage sensor 38.

Figure 4:
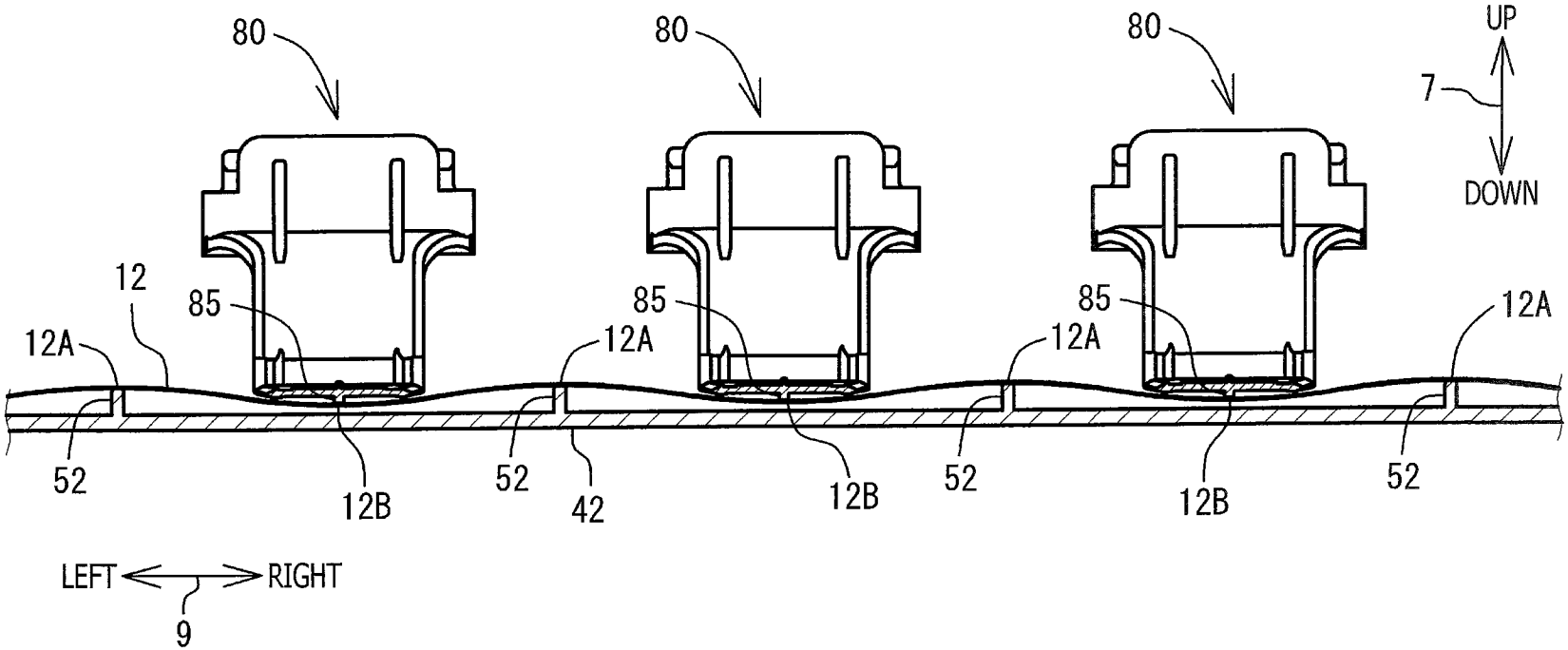
FIG. 4 is a partially cross sectional side view showing a positional relationship between supporting ribs of a platen and contacting ribs of contacting members of the printer unit according to aspects of the disclosures.

The platen 42 is arranged between, in the conveying direction 16, the conveying roller unit 54 and the discharging roller unit 55 as shown in FIG. 2. The platen 42 is arranged to face, in the up-and-down direction 7, the printing unit 24. On an upper surface of the platen 42, as shown in FIG. 4, a plurality of supporting ribs 52, which extend in the front-and-rear direction 8 and protrude upwardly, are formed. The plurality of supporting ribs 52 are arranged in the right-and-left direction 9 at every predetermined interval. The sheet 12 is supported by the plurality of supporting ribs 52 formed on the upper surface of the platen 42. According to the exemplary embodiment, a reflection index of the platen 42 is designed to be smaller than that of the sheet 12.

As shown in FIG. 2, there are multiple contacting members 80 which are arranged on an upstream side, in the conveying direction 16, with respect to the printing head 39. As shown in FIG. 4, the multiple contacting members 80 are separated from each other in the right-and-left direction 9. A distance between the lower surface of each of the contacting members 80 and the platen 42 is smaller than a distance between the lower surface of the printing head 39 and the platen 42. On the lower surface of each of the multiple contacting members 80, a contacting rib 85 protruding downward is formed. The contacting ribs 52 contact the upper surface of the sheet which is supported on the platen 42. With this configuration, the sheet 12 is pushed downward by the contacting members 80 (i.e., toward the platen 42). The positions of the contacting ribs 85 in the conveying direction 16 correspond to the corrugation formed positions B shown in FIG. 2.

As shown in FIG. 4, each of the multiple contacting members 80 is located between two adjacent supporting ribs 52 which are arranged next to each other in the right-and-left direction 9. In other words, the contacting ribs 85 and the supporting ribs 52 are arranged alternately in the right-and-left direction 9. Further, each supporting rib 52 protrudes to an upper position with respect to the lower end of the contacting ribs 85. Therefore, the supporting ribs 52 contact the sheet 12 at a position closer to the printing head 39 than the contact positions at which the contacting ribs 85 contact the sheet 12.

With the above-described configuration, the sheet 12 is sandwiched between the platen 42 and the contacting members 80 (i.e., the sheet 12 facing the printing head 39), and is formed to be corrugated when viewed from the conveying direction 16. That is, the sheet 12 facing the printing head 39 is formed to have a plurality of mountain peak positions 12A and a plurality of valley bottom positions 12B, which are arranged alternately. The mountain peak positions 12A are positions at which the sheet 12 protrudes toward the printing head 39 and the valley bottom positions 12B are positions at which the sheet 12 protrudes in a direction opposite to the printing head 39. In other words, the mountain peak positions 12A are positions at which a distance between the sheet 12 and the printing head 39 is changed from a decreasing state to an increasing state. The valley bottom positions 12B are positions at which a distance between the sheet 12 and the printing head 39 is changed from an increasing state to a decreasing state. It is noted that each of the mountain peak positions 12A is a boundary at which the distance between the sheet 12 and the printing head 39 is changed from a decreasing state to an increasing state. It is also noted that each of the valley bottom positions 12B is a boundary at which the distance between the sheet 12 and the printing head 39 is changed from a decreasing state to an increasing state.

It is noted that the ends of the contacting ribs 85 (i.e., the ends on the downstream side in the conveying direction 16) is an example of the corrugation positions, and is located between the conveying roller unit 54 and the printing head 39 in the conveying direction 16 (see FIG. 2). Further, the contacting members 80 and the supporting ribs 52 are examples of the corrugation forming mechanism which forms the sheet 12 to have the corrugated shape at a corrugation forming position B (see FIG. 2).

The medium sensor 122 is mounted on the carriage 23 as shown in FIG. 2. The medium sensor 122 is a reflective sensor configured to output a detection signal corresponding to amount of reflected light received from an object. According to the exemplary embodiment, the medium sensor 122 has a light emitting unit and a light receiving unit. The light emitting unit is configured to emit light, of which amount is controlled by the controller 130, toward the platen 42 (or the sheet 12 thereon). The light emitted by the light emitting unit is reflected by the sheet 12 supported by the platen 42, or by the platen 42 itself if the sheet 12 is not supported thereon. The light receiving unit receives the reflected light. The medium sensor 122 is configured to transmit a detection signal representing the light amount of the received light to the controller 130. For example, the medium sensor 122 transmits the detection signal of a higher level as the light amount of the received signal is higher.

Figure 5:
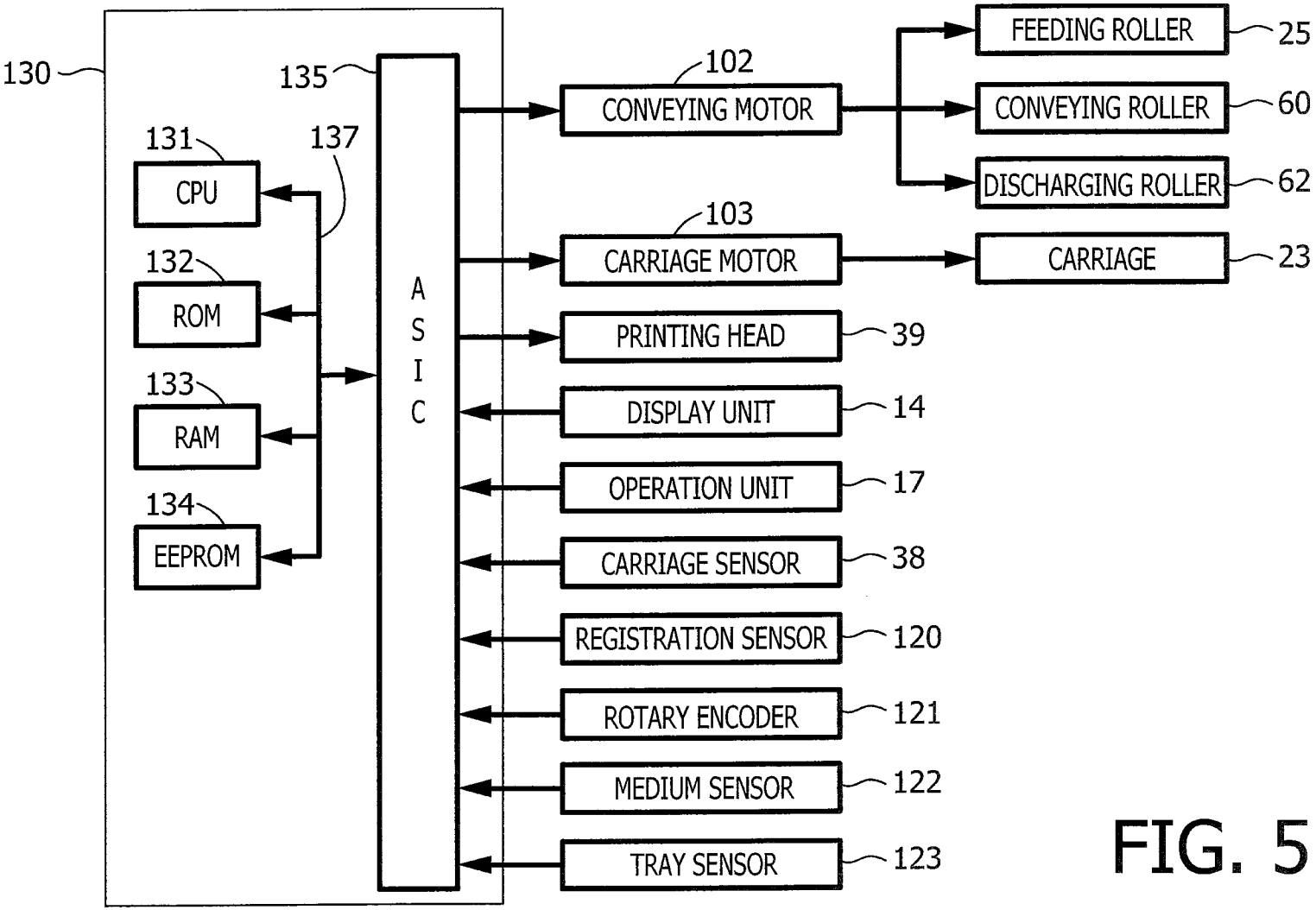
FIG. 5 is a block diagram of the printer unit according to aspects of the disclosures.

The printer unit 11 has a tray sensor 123 configured to output a signal corresponding to an attached/detached state of the feeding tray 20 as shown in FIG. 5. For example, the tray sensor 123 is configured to transmit an attached signal (e.g., a low level signal) to the controller 130 when the feeding tray 20 is attached to the printer unit 11, while when the feeding tray 20 is detached from the printer unit 11, the tray sensor 123 transmits a detached signal (e.g., a high level signal) to the controller 130.

It should be note that in the "detached state" does not necessarily mean that the feeding tray 20 is completely removed from the printer unit 11. For example, the "detached state" may include a state in which the feeding tray 20 is slightly drawn from the printer unit 11 (i.e., from the position at which the feeding tray 20 is in an "attached state"). It should also be noted that the "attached state" may also be a state where the feeding unit 15 can feed the sheet 12 supported by the feeding tray 20. It is also noted that the "detached state" may also be a state in which the sheet 12 can be inserted to the feeding tray 20 or drawn from the feeding tray 20.

The display unit 14 has a display screen which displays information to be notified to a user as messages and/or animated images. There is no specific requirement concerning the configuration of the display unit 14. For example, an LCD (liquid crystal display), an organic electro-luminescence display or the like may be employed for the display unit 14.

The operation unit 17 is an input interface for acquiring instructions for operating the MFP 10 from the user. There is no specific requirement concerning a structure of the operation unit 17. For example, a touch sensor may be overlaid on the display screen of the display unit 14. That is, the display unit 14 may be configured as a touch panel display. The operation unit 17 may be configured to detect a user selection of one of candidates (e.g., buttons) displayed on the display unit 14 displayed at a position where the user has touched. Alternatively or optionally, the operation unit 17 may include a plurality of mechanical buttons for user operations.

The controller 130 has, as shown in FIG. 5, a CPU (central processing unit) 131, a ROM (read only memory) 132, a RAM (random access memory) 133, an EEPROM (electrically erasable ROM) 134, and an ASIC (application specific integrated circuit) 135, which are interconnected through an inner bus 137. The ROM 132 stores programs causing the CPU 131 to control operations of respective components in the MFP 10. The RAM 133 is used as a temporary storage in which data and/or signals, which the CPU 131 uses when the CPU 131 executes the programs, are temporarily stored and/or used as a work area for data processing. The EEPROM 134 stores settings/parameters and flags to be retained after the MFP 10 is powered off.

To the ASIC 135, the conveying motor 102 and the carriage motor 103 are connected. The ASIC 135 obtains driving signals to rotate the conveying motor 102 and the carriage motor 103 from the CPU 131, and applies driving currents corresponding to the obtained driving signals to the conveying motor 102 and the carriage motor 103, respectively. Each motor is driven in accordance with the driving current from the ASIC 135 to forwardly or reversely rotate.

For example, the controller 130 controls the rotation of the conveying motor 102 to drive respective rollers. Further, the controller 130 drives the movement of the carriage motor 103 to reciprocally moves the carriage 23. Further, the controller 130 controls the printing head 39 to eject ink drops from the nozzles 40.

The ASIC 135 is connected with the carriage sensor 38, the registration sensor 120, the rotary encoder 121, the medium sensor 122 and the tray sensor 123. The controller 130 is configured to detect a position of the carriage 23 based on the pulse signal output by the carriage sensor 38. Further, the controller 130 is configured to detect the position of the sheet 12 based on the detection signal output by the registration sensor 120 and the pulse signal output by the rotary encoder 121. Further, the controller 130 is configured to detect side end positions of the sheet 12 in the right-and-left direction 9. Further, the controller 130 detects a status of the feeding tray 20 (i.e., the attached or the detached state) based on the signal output by the tray sensor 123.

The EEPROM 134 may store a carriage sensor value, a first ejection timing compensation value and a second ejection timing compensation value for each of a plurality of assumed mountain peak positions and a plurality of assumed valley bottom positions as shown in FIG. 6. It is noted that, in FIG. 6, characters (Pn, En, Xn and Yn) of which a suffix number (n) is an odd number, the values correspond to the assumed valley bottom positions or the valley bottom positions, while the characters of which a suffix number (n) is an even number, the values correspond to the assumed mountain peak positions or the mountain peak positions.

The assumed mountain peak positions are, for example, positions of the medium sensor 122, in the right-and-left direction 9, at which the medium sensor 122 is assumed to face the mountain peaks of the corrugated sheet 12, respectively. In other words, the assumed mountain peak positions are positions corresponding to the positions of the supporting ribs 52 in the right-and-left direction 9. The assumed valley bottom positions are, for example, positions of the medium sensors 122, in the right-and-left direction 9, at which the medium sensor 122 is assumed to face the valley bottom positions of the corrugated sheet 12, respectively. In other words, the assumed valley positions are positions corresponding to the positions of the contacting ribs 85 in the right-and-left direction 9. Each of the assumed mountain peak positions and the assumed valley bottom positions is stored in the EEPROM 134 as carriage sensor values E (enc). It is noted that the carriage sensor value E (enc) is, for example, an encoder value (e.g., the number of pulses with respect to a one end in the right-and-left direction 9) output by the carriage sensor 38 at each of the assumed mountain peak positions and the assumed valley bottom positions.

The first ejection timing compensation value X is a value for calculating the ejection timing at which the controller 130 controls the printing head 39 to eject the ink drops to the mountain peak positions and the valley bottom positions of the sheet 12 which is conveyed in the grain direction (i.e., the direction where the fibers of the sheet 12 are aligned). The second ejection timing compensation value Y is a value for calculating the ejection timing at which the controller 130 controls the printing head 39 to eject the ink drops to the mountain peak positions and the valley bottom positions of the sheet 12 which is conveyed in the direction perpendicular to grain direction. According to the exemplary embodiment, each of the first ejection timing compensation values Xn and the second ejection timing compensation values Yn represents a differential value with respect to a reference value D0 of the ejection timing. According to the exemplary embodiment, each of the first ejection timing compensation value Xn and the second ejection timing compensation value Yn is a numerical value equal to or greater than zero (0). In the following description, conveying of the sheet 12 in the grain direction will be referred to as a grain direction conveyance, and conveying the sheet 12 in a direction perpendicular to the grain direction will be referred to as a cross-grain conveyance.

The reference value D0 represents the ejection timing for causing the ink drop to reach an intermediate position between an adjacent mountain peak position 12A and a valley bottom position 12B in the up-and-down direction 7 (i.e., in a direction where the printing head 39 faces the sheet 12). The reference value D0 indicates that, for example, the printing head 39 should reject an ink drop D0 seconds before a point of time at which the ejected ink drop reaches an immediately above the intermediate position. The reference value D0 is, for example, stored in the EEPROM 134.

In the EEPROM 134, as shown in FIG. 6, an area to store signal levels of the detection signals output from the medium sensor 122 (hereinafter, referred to as medium sensor values) at the assumed mountain peaks and the assumed valley bottoms is defined. In this area, the medium sensor values obtained in a signal level difference calculation process (described later) are stored. Further, the EEPROM 134 is configured to store a tray-removal flag. The tray-removal flag is set to "ON" in response to output of the detached signal from the tray sensor 123, while set to "OFF" in response to execution of the signal level difference calculation process.

Referring to FIGS. 7-11, an image printing process executed by MFP 10 will be described. Specifically, the image printing process is executed by the CPU 131 of the controller 130. It is noted that following processes may be executed such that the CPU 131 retrieves programs stored in the ROM 132 or realized by a hardware circuit implemented in the controller 130. The image printing process shown in FIG. 7 is started in response to input of the print instruction acquired by the MFP 10. The print instruction is an instruction to cause the MFP 10 to execute the process to print the image represented by the image data on the sheet 12. There is no specific requirement concerning origin of the print instruction. For example, the print instruction may be obtained through the operation unit 17 of the MFP 10, or from an external device through the communication network.

When the image printing process is invoked, firstly, the controller 130 executes an initial feeding process (S11). The initial feeding process is to convey the sheet 12 accommodated in the sheet tray 20 to a position at which an area where the image is to be firstly recorded faces the printing head 39. According to the exemplary embodiment, the controller 130 drives the conveying motor 102 so that the sheet 12 held in the sheet tray 20 is conveyed by the feeding roller 25. Next, the controller 130 drives the conveying motor 102 so that the sheet 12 conveyed by the feeding roller 25 is further fed by the conveying roller 60 of the conveying roller unit 54. It is noted that a position of a leading end of the sheet 12 is identified based on a combination of a variation of the signal output by the registration sensor 120 and pulse signals output by the rotary encoder 121.

Next, when the tray-removal flag is set to "ON" (S12: YES), the controller 130 executes the signal level difference calculation process (S13) and sets the tray-removal flag to "OFF" (S14). When the tray-removal flag is set to "OFF" (S12: NO), the controller 130 proceeds to S15 skipping S13 and S14.

Referring to FIG. 8, the signal level difference calculation process will be described in detail. Firstly, the controller 130 moves the carriage 23 in the right-and-left direction 9 with causing a light emitting unit of the medium sensor 122 to emit light (S31). Then, the controller 130 obtains the detection signal output by the medium sensor 122 (i.e., the medium sensor value) in association with the encoder value of the carriage sensor 38. According to the exemplary embodiment, it is assumed that the medium sensor values which change as shown in FIGS. 9A and 9B are obtained from the medium sensor 122. As shown in FIGS. 9A and 9B, the medium sensor values are higher at positions where a distance between the sheet 12 and the printing head 39 is smaller (i.e., at the mountain peak positions 12A), while the medium sensor values are smaller at positions where a distance between the sheet 12 and the printing head 39 is longer (i.e., at the valley bottom positions). Further, the medium sensor value at a position of the platen 42 is apparently smaller than the medium sensor values at any position on the sheet 12.

Next, the controller 130 stores the medium sensor values at the assumed mountain peak positions (P2, P4, . . . P16) and the assumed valley bottom positions (P1, P3, . . . , P17) from among the medium sensor values obtained in S31 in the EEPROM 134 (S32). It is noted that the medium sensor values stored in EEPROM 134 in S32 contain ones included within a mountain peak zone including the assumed mountain peak positions and ones included within a valley bottom zone including the assumed valley bottom positions. The medium sensor value(s) included in each of the mountain peak zone and the valley bottom zone may be one or more.

According to the exemplary embodiment, within one mountain zone and one valley zone, one assumed mountain peak position (one of P2, P4, . . . P16) and one assumed valley bottom position (one of P1, P3, . . . P17) are included, respectively. Further, a distance of each zone can be set by considering positional tolerances of the contacting ribs 85 and the supporting ribs 52. For example, when the positional tolerance of the contacting ribs 85 and the supporting ribs 52 is ±1 mm, and a resolution of the carriage sensor 38 is 150 dpi (=1 enc≈0.17 mm), a zone of 6 enc's (which is nearly equal to 1 mm) is defined on each of right and left sides with respect to one assumed mountain peak position and one assumed valley bottom position (thus, a distance of each zone is 12 enc's), which are defined as the mountain peak zone and the valley bottom zone.

In other words, the distance of the mountain peak zone and the valley bottom zone may correspond to the positional tolerance of the members (e.g., the contacting ribs 85 and the supporting ribs 52) constituting the corrugation forming mechanism, with respect to the assumed mountain peak position and the assumed valley bottom position. Alternatively, the distance of each zone may be the distance which is the above positional tolerance added with some margin. In the EEPROM 134, instead of carriage sensor values E identifying the assumed mountain peak positions and the assumed valley bottom positions, carriage sensor values E identifying the positions of the mountain peak zones and the valley bottom zones may be stored.

In S32, the controller 130 may store an average value, a maximum value, a minimum value or a median value in the EEPROM 134 as the medium sensor value at the assumed mountain peak position. For example, the maximum value of the medium sensor value in each mountain peak zone and the minimum value of the medium sensor value in each valley bottom zone may be stored in the EEPROM 134. For another example, the average value of the medium sensor values in each of the mountain peak zone and in each of the valley bottom zone may be stored in the EEPROM 134.

Next, the controller 130 obtains the end positions of the sheet 12 in the right-and-left direction 9 (S33). For example, the controller 130 obtains the carriage sensor values E at a position at which the medium sensor value obtained in S31 is changed from a state exceeding an edge threshold value, which represents the boundary between the sheet 12 and the platen 42, to a state lower than the edge threshold value, and at a position at which the medium sensor value obtained in S31 is changed from a state below the edge threshold value to a state exceeding the edge threshold value, as the end positions of the sheet 12 in the right-and-left direction 9. It is noted that S33 should not be limited to a step of obtaining the both ends of the sheet 12 in the right-and-left direction 9. For example, the controller 130 may obtain only one side end position of the sheet 12 in S33, and the controller 130 calculates the position of the other end of the sheet 12 based on the one end position and the size of the sheet 12. Alternatively, a sensor unit configured to detect a position of the side guide which positions an end of the sheet 12 in the right-and-left direction 9 may be provided to the sheet tray 20. In such a case, the controller unit 130 may obtain the signals output by such a sensor as the end position of the sheet 12.

The controller 130 may execute the processes of S31-S33 in parallel. For example, the controller may obtain a position at which the medium sensor value obtained in S31 is changed from a state below the edge threshold value to a state exceeding the edge threshold value, as the end positions of the sheet 12 (S33) when executing S31. Further, the controller 130 may store the medium sensor value at each assumed mountain peak position (mountain peak zone) and each assumed valley bottom position (valley bottom zone) in the EEPROM 134 when executing S31. Furthermore, the controller 130 may obtain a position at which the medium sensor value obtained in S31 is changed from a state exceeding an edge threshold value to a state lower than the edge threshold value as the other end position of the sheet 12 when executing S31.

Then, the controller 130 deletes the medium sensor value of the assumed mountain peak position or the assumed valley bottom position next to the end position of the sheet from among the medium sensor values stored in the EEPROM 134 in S32 (S34). According to the exemplary embodiment, the medium sensor values corresponding to the valley bottom positions P1 and P17 are deleted.

Next, the controller 130 calculates a mountain peak representative value (S35). According to the exemplary embodiment, the controller 130 determines one of an average value, a maximum value, a minimum value, or a median value of the medium sensor values at the assumed mountain peak positions stored in EEPROM 134 in S32 as the mountain peak representative value. Further, the controller 130 calculates a valley bottom representative value (S36). According to the exemplary embodiment, the controller 130 determines one of an average value, a maximum value, a minimum value, or a median value of the medium sensor values at the assumed valley bottom positions stored in EEPROM 134 in S32 as the valley bottom representative value. It is noted that the controller 130 does not necessarily execute S34. When S34 is not executed, the controller 130 may determine the mountain representative value and the valley representative value without referring to the medium sensor values at the assumed mountain peak position or the assumed valley bottom positions next to the end positions of the sheet 12 in S35 and S36. That is, the controller 130 may simply neglect the medium sensor values at the assumed mountain peak position or the assumed valley bottom position next to the end positions of the sheet 12 in S35 and S36.

Next, in S37, the controller 130 calculates a signal level difference by subtracting the valley bottom representative value from the mountain peak representative value. The controller 130 stores the thus calculated signal level difference in the EEPROM 134, and terminates the signal level difference calculation process.

When the signal level difference stored in the EEPROM 134 is equal to or greater than a threshold value (S15: YES), the controller 130 executes a first ejection process (S16). When the signal level difference stored in the EEPROM 134 is less than the threshold value (S15: NO), the controller 130 executes a second ejection process (S17).

Hereinafter, the first and second ejection processes will be described with reference to FIG. 10. When the first ejection process is to be executed (S41: YES), the controller 130 calculates ejection timings for causing the ink drops to reach respective mountain peak positions (hereinafter, referred to as mountain peak ejection timings) and ejection timings for causing the ink drops to reach respective valley bottom positions (hereinafter, referred to as valley bottom ejection timings) using a first ejection timing compensation value, X(m) (S42, S43). When the second ejection process is to be executed (S41: NO), the controller 130 calculates the mountain peak ejection timings and the valley bottom ejection timings using a second ejection timing compensation value, Y(m) (S44, S45). The reason why the ejection timings are differentiated for the ejection processes will be described later.

According to the exemplary embodiment, the controller 130 calculates the ejection timings D1(m) at respective mountain peak positions by subtracting each of the first ejection timing compensation values X(m) from the reference value D0 in S42. Similarly, the controller 130 calculates the ejection timings D1(m) at respective mountain peak positions by subtracting each of the second ejection timing compensation values Y(m) from the reference value D0 in S42. According to the exemplary embodiment, the first ejection timing values X(m) is greater than the second ejection timing values Y(m) for the same m. That is, the ejection timings for the mountain peak positions according to the first ejection process are delayed with respect to the ejection timings for the mountain peak positions according to the second ejection process. It is noted that, in S42 and S44, m=2, 4, . . . , 16.

Further, according to the exemplary embodiment, the controller 130 calculates the ejection timings D1(m) at respective valley bottom positions by adding each of the first ejection timing compensation values X(m) to the reference value D0 in S43. Similarly, the controller 130 calculates the ejection timings D1(m) at respective valley bottom positions by adding each of the second ejection timing compensation values Y(m) to the reference value D0 in S45. Since the first ejection timing values X(m) is greater than the second ejection timing values Y(m) for the same m, the ejection timings for the valley bottom positions according to the first ejection process are earlier with respect to the ejection timings for the valley bottom positions according to the second ejection process. It is noted that, in S43 and S45, m=1, 3, . . . , 17.

Next, the controller 130 further adjusts the mountain peak ejection timings and the valley bottom ejection timings (S47-S52) based on the position of the trailing end of the sheet 12 (S46). The position of the trailing end of the sheet 12 is identified based on a combination of a variation of the signal output by the registration sensor 120 and the pulse signal output by the rotary encoder 121. It is noted that processes of S46-S52 are commonly executed in the first ejection process and the second ejection process. Further, ejection timing adjustment values α and β are numerical value representing a time and equal to or greater than zero, and stored in the EEPROM 134. The reason why the ejection timings are differentiated based on the position of the trailing end of the sheet 12 will be described later.

When the trailing end of the sheet 12 is located on upstream, in the sheet conveying direction 16, with respect to a nip position A (see FIG. 2) of the conveying roller unit 54, that is, when the sheet 12 is nipped between the conveying roller 60 and the pinch roller 61 (hereinafter, this situation (i.e., the position of the trailing end≤A) will be referred to as a case 1), the controller 130 does not adjust the mountain peak ejection timings or the valley bottom ejection timings (S47, S48). When the trailing end of the sheet 12 is located on downstream, in the sheet conveying direction 16, with respect to the nip position A and on upstream with respect to the corrugation forming position B (hereinafter, this situation will be referred to as a case 2), the controller 130 adjusts the mountain peak ejection timings and the valley bottom ejection timings using the ejection timing adjustment value α (S49, S50). When the trailing end of the sheet 12 is located on downstream, in the sheet conveying direction 16, with respect to the corrugation forming position B (hereinafter, this situation will be referred to as case 3), the controller 130 adjusts the mountain peak ejection timings and the valley bottom ejection timings using the ejection timing adjustment value β (S51, S52). It is noted that the alpha and beta are values representing time periods, α being a positive value and β being a negative value.

According to the exemplary embodiment, in S49, the controller 130 calculates an adjusted mountain peak ejection timing D(m) by subtracting the ejection timing adjustment value α from each mountain peak ejection timing D1(m). Further, in S50, the controller 130 calculates an adjusted valley bottom ejection timing D(m) by adding the ejection timing adjustment value α to each valley bottom ejection timing D1(m). Thus, the adjusted mountain peak ejection timing D(m), which is equal to D1(m)−α, is latened in comparison with the mountain peak ejection timing D(m) before adjusted. Further, the adjusted valley bottom ejection timing D(m), which is equal to D1(m)+α, is expedited in comparison with the valley bottom ejection timing D(m) before adjusted. Accordingly, the mountain peak ejection timing in case 2 is latened in comparison with that in case 1, while the valley bottom ejection timing in case 2 is expedited in comparison with that in case 1.

In S51, the controller 130 calculates an adjusted mountain peak ejection timing D(m) by subtracting the ejection timing adjustment value β from each mountain peak ejection timing D1(m). Further, in S52, the controller 130 calculates an adjusted valley bottom ejection timing D(m) by adding the ejection timing adjustment value β to each valley bottom ejection timing D1(m). Thus, the adjusted valley bottom ejection timing D(m), which is equal to D1(m)−β, is expedited in comparison with the mountain peak ejection timing D(m) before adjusted since β is a negative value. Further, the adjusted valley bottom ejection timing D(m), which is equal to D1(m)+β, is latened in comparison with the valley bottom ejection timing D(m) before adjusted. Accordingly, the mountain peak ejection timing in case 3 is expedited in comparison with that in case 1, while the valley bottom ejection timing in case 3 is latened in comparison with that in case 1.

Because of the relationship between case 2 and case 1, and between case 3 and case 1, the followings are concluded. That is, the mountain peak ejection timing when the trailing end of the sheet 12 has passed the corrugation forming position B (i.e., case 3) is expedited in comparison with that when the trailing end of the sheet 12 has not yet passed the corrugation forming position B (i.e., cases 1 and 2). Further, the valley bottom ejection timing when the trailing end of the sheet 12 has passed the corrugation forming position B (i.e., case 3) is latened in comparison with that when the trailing end of the sheet 12 has not yet passed the corrugation forming position B (i.e., cases 1 and 2). It is noted that, in S49 and S51, m=2, 4, . . . , 16. Further, in S50 and S52, m=1, 3, . . . , 17.

Next, the controller 130 calculates the ejection timings for casing the ink drops to reach the intermediate position between the mountain peak position 12A and the valley bottom position 12B (S53). According to the exemplary embodiment, by substituting the ejection timings D for the mountain peak position 12A and the valley bottom position 12B which are next to the intermediate position, and information representing a distance from each of the mountain peak position 12A and the valley bottom position 12B to the intermediate position into an interpolation function, the ejection timing D at each of the intermediate positions is calculated. The interpolation function may not be limited to a specific one, and a cubic function may be used, for example.

The controller 130 causes the printing head 39 to eject the ink drops to reach each of the mountain peak positions, valley bottom positions and intermediate positions at the ejection timings D (S54), and terminates the ejection process. With the above operation, an image is printed on a surface, which faces the printing head 39, of the sheet 12.

When printing of an image on the sheet 12 has not be completed (S18: NO), the controller 130 executes a conveying process (S20, S21). That is, when the signal difference level stored in the EEPROM 134 is equal to or greater than the threshold value (S19: YES), the controller 130 executes a first conveying process (S20). When the signal difference level stored in the EEPROM 134 is less than the threshold value (S19: NO), the controller 130 executes a second conveying process (S21). The conveying process is a process to convey the sheet in the conveying direction 16 by a predetermined line feed width (hereinafter, the line feed width will be referred to as a conveying amount). It is noted that the conveying amount per one conveying process is different in the first conveying process and the second conveying process.

Hereinafter, referring to FIG. 11, the conveying process will be described in detail. When the first conveying process is to be executed (S61: YES), the controller 130 sets a reference conveying amount L0 to a conveying amount L1 (S62). When the second conveying process is to be executed (S61: NO), the controller 130 calculates the conveying amount L1 by adding a conveying amount compensation value γ to the reference conveying amount L0 (S63). It is noted that both the reference conveying amount L0 and the conveying amount compensation value γ are numeric values representing distances and equal to or greater than zero, and stored in the EEPROM 134. Thus, the conveying amount according to the second conveying process is equal to or greater than the conveying amount according to the first conveying process. The reason why the conveying amounts are differentiated in the first and second conveying processes will be described later.

Next, depending on the location of the trailing end of the sheet 12 (S64), the controller 130 further adjust the conveying amount L1 (S65, S66). It is noted that the processes of S65 and S66 are executed commonly in the first conveying process and the second conveying process. When the trailing end of the sheet 12 is located on upstream, in the conveying direction 16, with respect to the corrugation forming position B (S64: Position of Trailing End≤B), the controller 130 does not further adjust the conveying amount L1 (S65). That is, in this case, an adjusted conveying amount L equals to the conveying amount L1. When the trailing end of the sheet 12 is on downstream, in the conveying direction 16, with respect to the corrugation forming position B (S64: B<Position of Trailing End), the controller calculates the adjusted conveying amount L by adding a conveying amount adjustment value θ to the conveying amount L1 (S66).

It is noted that the conveying amount adjustment value θ is a numerical value representing a distance, which is equal to or greater than zero, and stored in the EEPROM 134. That is, the conveying amount immediately after the trailing end of the sheet 12 has passed the corrugation forming position B is greater than the conveying amount before the trailing end of the sheet 12 passes the corrugation forming position B. The reason why the conveying amount is differentiated depending on the location of the trailing end of the sheet will be described later.

The controller 130 forwardly rotating the conveying motor 102 to forwardly rotate the conveying roller 54 and the discharge roller 55 until the sheet 12 is conveyed in the conveying direction 16 by the conveying amount L (S67). When the sheet 12 is conveyed by the conveying amount L, the controller 130 terminates the conveying process. According to the exemplary embodiment, the reference conveying amount L0, the conveying amount compensation value γ, and the conveying amount adjustment value θ are stored in the EEPROM 134 as numerical values representing distances. It is note that the above numerals need not be stored in the EEPROM 134 as numerical values representing distances. For example, since the distance is proportional to a rotated amount of the conveying motor 102, the reference conveying amount L0, the conveying amount compensation value γ, and the conveying amount adjustment value θ may be stored in the EEPROM 134 as numerical values representing the rotation amount of the conveying motor 102.

The controller 130 repeatedly executes S15-S21 until (S18: NO) printing of an image on the sheet 12 is completed. When printing of the image on the sheet 12 has been completed (S18: YES), the controller 130 executes a discharging process to discharge the sheet 12, on which the image has been printed, onto the discharge tray 21 (S22). According to the exemplary embodiment, the controller 130 drives the conveying motor 102 until at least the trailing end of the sheet 12 passes the discharging roller unit 55. The controller 130 repeatedly executes S11-S22 until all the images included in the print instruction have been printed (S23: YES). When all the images included in the print instruction have been printed (S23: NO), the controller 130 terminates the image printing process.

According to the above-described configuration, by comparing the signal level difference with the threshold value, the first condition, which is suitable to the sheet 12 conveyed in accordance with the texture-direction conveyance, and the second condition, which is suitable to the sheet 12 conveyed in accordance with the transverse-texture conveyance, are switched when the image printing process is executed. Accordingly, deterioration of the image quality due to the direction of the texture of the sheet 12 can be suppressed.

According to the exemplary embodiment, a case where the signal level difference is equal to or greater than the threshold value corresponds to the texture-direction conveyance, while a case where the signal level difference is less than the threshold value corresponds to the transverse-texture conveyance.

By storing the signal level difference calculated in S37 in the EEPROM 134, the signal level difference calculation process is prevented from being executed every time the image printing process is executed. For example, all the sheets 12 accommodated in the sheet tray 20 could be regarded to have the same texture characteristics. Accordingly, until the sheet tray 20 is removed from the printer (i.e., until the sheets 12 in the sheet tray 20 might be replaced), execution conditions of the ejection process and the conveying process can be controlled based on the signal level difference stored in the EEPROM 134.

The corrugated shape at end portions of the sheet 12 in the right-and-left direction 9 is unstable in comparison with the corrugated shape at a central portion of the sheet 12. Therefore, in S34, the medium sensor value at the assumed mountain peak position or at the assumed valley bottom position adjacent to the end position of the sheet 12 is removed from the EEPROM 134.

Alternatively, in S35 and S36, the mountain peak representative value and the valley bottom representative value may be calculated without using the medium sensor values of the assumed mountain peak position or the assumed valley bottom position adjacent to the end positions of the sheet 12.

Thus, in S35-S37, based on the medium sensor values of the assumed mountain peak positions which are not adjacent to the end positions of the sheet 12 and the medium sensor values of the assumed valley positions which are not adjacent to the end positions of the sheet 12, the signal level difference can be calculated. As a result, deterioration in accuracy of the calculation of the signal difference levels can be suppressed.

According to the exemplary embodiment, based on the medium sensor values respectively associated with the plurality of assumed mountain peak positions, the mountain peak representative value is calculated (S36), and based on the medium sensor values respectively associated with the plurality of assumed valley bottom positions, the valley bottom representative value is calculated (S37). Then, based on the mountain peak representative value and the valley bottom representative value, the signal level difference is calculated. Accordingly, deterioration of accuracy of the calculation due to position tolerance can be suppressed.

There is a tendency that a magnitude of fluctuation of the corrugated shape of the sheet 12 (hereinafter, referred to as a corrugation magnitude) is greater in the sheet 12 of texture-direction conveyance than in the sheet 12 of transverse-texture conveyance. In other words, in the sheet 12 of the texture-direction conveyance, each mountain peak position in the up-and-down direction 7 closer to the printing head 39 and the each valley bottom position in the up-and-down direction 7 is farther from the printing head than in the sheet 12 of the transverse-texture conveyance. Therefore, for the sheet 12 of the texture-direction conveyance, the ink drops to reach the mountain peak positions should be ejected at a latened timing, while the ink drops to reach the valley bottom positions should be ejected at an expedited timing.

Accordingly, it is advantageous as described in the exemplary embodiment that the compensation amount for the ejection timing for the sheet 12 of the texture-direction conveyance (i.e., the first ejection timing compensation value X) is greater than the compensation amount for the ejection timing for the sheet 12 of the transverse-texture conveyance (i.e., the second ejection timing compensation value Y). It is noted that, FIG. 6 shows an example in which the first ejection timing compensation value X and the second ejection timing compensation value Y are calculated for each of the assumed mountain peak positions and the assumed valley bottom positions. Such a configuration may be modified such that the common values of the first ejection timing compensation value X and the second ejection timing compensation value Y may be used for all the assumed mountain peak positions and the assumed valley bottom positions.

It is necessary to differentiate the ejection timings in case 1 where the trailing end of the sheet 12 is located on upstream, in the conveying direction 16, with respect to the nip position A, in case 2 where the trailing end of the sheet 12 is located between the nip position A and the corrugation forming position B, and in case 3 where the trailing end of the sheet 12 is located on downstream, in the conveying direction, with respect to the corrugation forming position B.

In case 1, in addition to the force applied by the corrugation forming mechanism (at least by the supporting ribs 52 and the contacting ribs 85), the nipping force by the conveying roller unit 54 is applied to the sheet 12. In case 2, the force by the corrugation forming mechanism is applied to the sheet 12. Accordingly, in case 2, the sheet 12 is released from a corrective force (which tends to flatten the corrugated sheet 12) applied by being nipped in the conveying roller unit 54, the corrugation magnitude tends to be greater in comparison with case 1. In case 3, a force is applied by the supporting ribs 52. That is, in case 3, the sheet 12 is released from the force applied by the contacting ribs 85, the corrugation magnitude tends to be smaller in comparison with cases 1 and 2.

The corrugation magnitude of the sheet 12 which has passed the corrugation forming position B (i.e., in case 3) tends to be smaller than that of the sheet 12 before passing the corrugation forming position B (i.e., in case 1 or case 2). Accordingly, for the sheet 12 which as passed the corrugation forming position B, the ink drops to reach the mountain peak positions should be ejected at expedited timings, while the ink drops to reach the valley bottom positions should be ejected at latened timings in comparison with the case where the sheet 12 has not passed the corrugation forming position B. Therefore, it is advantageous, as described above, that the ejection timing compensation value for the sheet 12 which has not passed the corrugation forming position B is greater than that for the sheet 12 which has passed the corrugation forming position B. It is noted that the ejection timing adjustment values $\alpha$ and $\beta$ may be values set to respective ones for the assumed mountain peak positions and the assumed valley bottom positions as the first ejection timing compensation values X and the second ejection timing compensation values Y.

The sheet 12 expands when it absorbs the ink, and there is a tendency that an expansion amount, in the conveying direction 16, of the sheet 12 of the transverse-texture conveyance is greater than that of the sheet 12 of the texture-direction conveyance. Accordingly, it may be advantageous that the conveying amount of the sheet 12 of the transverse-texture conveyance (i.e., the conveying amount in the second conveying process) is larger than that of the sheet 12 of the texture-direction conveyance (i.e., the conveying amount in the first conveying process).

As mentioned above, the sheet 12 expands when it absorbs the ink, and there is a tendency that an expansion amount, in the conveying direction 16, of the sheet 12 having passed the corrugation forming position B is larger than that of the sheet 12 which has not passed the corrugation forming position. Accordingly, it is advantageous that the conveying amount of the sheet 12 which has passed the corrugation forming position B is larger than that of the sheet 12 which has not passed the corrugation forming position, as in the exemplary embodiment.

Next, referring to FIG. 12, a sheet discriminating device will be described. The sheet discriminating device may be an independent device, or may be provided as a function of a printing device, multi-function peripheral or the like. According to the exemplary embodiment, the configuration of the sheet discriminating device is substantially similar to that shown in FIGS. 1-5. It is noted, however, a component to print an image on the sheet 12 (e.g., the printing head 39) is not necessary to realize a function of discriminating whether texture is aligned in the sheet conveying direction, or in a direction orthogonal to the sheet conveying direction. In the following description referring to FIG. 12, detailed description of steps similar to those shown in FIGS. 7 and 8 will be omitted, and steps different from those in FIGS. 7-8 will be mainly described.

In FIG. 12, the controller 130 obtains direction information indicative of a direction of a longer dimension of the sheet 12 which is conveyed by a conveyor (e.g., the feed unit 15, the conveying roller unit 54 and the discharging unit 55) in S71. According to the exemplary embodiment, the direction information indicates whether a longer dimension direction of the sheet 12, which faces the medium sensor 122, is aligned in the conveying direction 16 or in the scanning direction. Alternatively, the controller 130 may also obtain a size of the sheet 12 and end positions of the sheet 12 in the right-and-left direction 9 as the direction information. In such a case, the positions of the ends of the sheet 12 may be obtained as in S33 of FIG. 8. Alternatively, the controller 130 may obtain the size of the sheet 12 and positions of side guides of the feed tray 20 as the direction information.

Next, the controller 130 executes the signal level difference calculation process (S72). Since the signal level difference calculation process has already been described with reference to FIG. 8, it will not be repeated for brevity. Then, based on a combination of the direction information obtained in S71 and the signal level difference calculated in S72 (S73, S74, S75), the controller 130 determines whether the sheet 12 subject to detection is a long-grain sheet (i.e., a sheet of which fibers are aligned in a longer dimension of the sheet) or a short-grain sheet (i.e., a sheet of which fibers are aligned in a shorter dimension of the sheet) (S75, S76, S78, S79). Then, the controller 130 terminates the sheet discriminating process.

Specifically, when the signal level difference is equal to or greater than the threshold value (S73: YES), if the longer dimension of the sheet 12 is aligned along the conveying direction 16 (S74: conveying direction), the controller 130 notifies that the sheet 12 is the long-grain sheet (S75), while if the longer dimension is aligned in the scanning direction (S74: scanning direction), the controller 130 notifies that the sheet 12 is the short-grain sheet (S76).

When the signal level difference is less than the threshold value (S73: NO), if the longer dimension of the sheet 12 is aligned along the conveying direction 16 (S77: conveying direction), the controller 130 notifies that the sheet 12 is the short-grain sheet (S78), while if the longer dimension of the sheet 12 is aligned along the scanning direction (S77: scanning direction), the controller 130 notifies that the sheet is the long-grain sheet (S79).

Methods of notification should not be limited to specific ones. For example, the controller 130 may display, on the display unit 14, whether the sheet is conveyed in the grain direction or cross-grain direction. Optionally or alternatively, the controller 130 may notify by sound or voice notification. Further, the notification of grain/cross-grain directions need not be executed immediately after steps S71 and S72 are executed. For example, the sheet discriminating device may store discrimination result (i.e., information representing whether the sheet is conveyed in the grain direction or the cross-grain direction) in S73, S74 and S77 in the EEPROM 134. In such a case, the discrimination result may be notified when a request for such a notification is received from the user.

Steps S75, S76, S78 and S79 may include change of destination (i.e., a tray on which a sheet is discharged) of the sheet 12 depending on an orientation of the sheet and the grain direction. For example, the sheet discriminating device has a plurality of discharge trays 21, and the controller 130 may be configured to discharge the sheet 12 that is discriminated to be the long-grain sheet to a first discharge tray, while the sheet 12 that is discriminated to be the short-grain sheet to a second discharge tray.

Steps S75, S76, S78 and S79 may include display, on the display unit 140, a method of placing the sheets 12 of which the grain direction has been discriminated on the feeding tray 20. For example, when the sheet discriminating device is realized as a part of the MFP 10, the controller 130 may display a method of placing the sheets 12 with the longer dimension being aligned along the front-and-rear direction 8 in S75 or S78, while a method of placing the sheets 12 with the longer dimension being aligned along the right-and-left direction 9 in S76 or S79.

According to the sheet discriminating device described above, whether a sheet is the long-grain sheet of the short-grain sheet is automatically discriminated and notified to the user. It is again noted that the long-grain sheet is a sheet of which fibers extend in the longer sheet dimension, while the short-grain sheet is a sheet of which the fibers extend in the shorter sheet dimension.

In the exemplary embodiment, it is described that the degree of corrugation of the sheet 12 depends on whether the grain direction meets the sheet conveying direction or the scanning direction (e.g., the direction perpendicular to the sheet conveying direction). It is noted that the degree of corrugation may also vary depending on stiffness or rigidity of the sheet, thickness of the sheet and/or material of the sheet. Since the inkjet printer according to the exemplary embodiment detects the degree of the corrugation, even if various types (in grain, stiffness, thickness and/or material) of sheets are used, the ink ejection timings can be appropriately controlled.

Further, if it is known in advance that two types of sheets are different by one of the grain, stiffness, thickness and material, the sheet discriminating device according to the exemplary embodiment can discriminate the two types of sheets. When the difference of the two types of sheets are based on the stiffness, thickness or material, the degree of the corrugation remains the same regardless of the orientation of the sheet. Therefore, in such a case, steps S74-S79 (in FIG. 12) may be omitted and the two types of the sheets are discriminated based on the determination result of S73.

What is claimed is:

1. An inkjet printer, comprising:

a sheet conveyor configured to convey a sheet in a conveying direction;

a printing head configured to eject ink drops on the sheet conveyed by the sheet conveyor;

a first sensor which is a reflective sensor configured to output a first detection signal corresponding to a received amount of reflected light;

a carriage mounting the printing head and the first sensor thereon and configured to move in a scanning direction which intersects with the conveying direction;

a corrugation forming mechanism configured to form the sheet to have a corrugated shape so as to have mountain peak positions and valley bottom positions which are alternately arranged in the scanning direction at a portion facing the printing head, the sheet being deformed toward the printing head at the mountain peak positions and deformed away from the printing head at the valley bottom positions;

a storage configured to store information representing a plurality of assumed mountain peak positions and a plurality of assumed valley bottom positions, the plurality of assumed mountain peak positions corresponding to positions at which the first sensor faces the mountain peak positions in the scanning direction and the plurality of assumed valley bottom positions corresponding to positions at which the first sensor faces the valley bottom positions in the scanning direction; and a controller, the controller being configured to:

execute movement of the carriage across the sheet in the scanning direction;

during the movement of the carriage in the scanning direction, receive the first detection signal from the first sensor;

after receipt of the first detection signal, identify a first signal level at the plurality of assumed mountain peak positions in the scanning direction based on both the plurality of assumed mountain peak positions stored in the storage and the first detection signal, the first signal level corresponding to the signal level of the first detection signal in a mountain peak zone including the assumed mountain peak position;

after receipt of the first detection signal, identify a second signal level at the plurality of assumed valley bottom positions in the scanning direction based on both the plurality of assumed valley bottom positions stored in the storage and the first detection signal, the second signal level corresponding to the signal level of the first detection signal in a valley bottom zone including the assumed valley bottom positions;

after identification of both the first signal level and the second signal level, calculate a signal level difference between the first signal level and the second signal level;

after completion of calculation of the signal level difference, execute a decision process in which the controller decides whether the calculated signal level difference is less than a predetermined threshold value; and execute a printing process in which the controller alternately executes, during the movement of the carriage, an ejection process of causing the printing head to eject ink drops, and a conveying process of causing the conveyor to convey the sheet by a predetermined line feed width, wherein, in the printing process:

based on decision of the calculated signal level difference being not less than the predetermined threshold in the decision process, the controller causes the printing head to eject ink drops and causes the conveyor to convey the sheet according to a first condition; and based on decision of the calculated signal level difference being less than the predetermined threshold in the decision process, the controller causes the printing head to eject ink drops and causes the conveyor to convey the sheet according to a second condition different from the first condition.

2. The inkjet printer according to claim 1, wherein the controller executes an obtaining process in which the controller obtains end positions, in the scanning direction, of the sheet, and wherein, in the calculation process, the controller calculates the signal level difference between the first detection signal in the mountain peak zone including the assumed mountain peak position which is not adjacent to the end position and the first detection signal in the valley bottom zone including the assumed valley bottom position which is not adjacent to the end position.

3. The inkjet printer according to claim 1, wherein, in the calculation process, the controller calculates the signal level difference between one of an average value and a maximum value of the plurality of first detection signals in the mountain beak zone and one of an average value and a minimum value of the plurality of first detection signals in the valley bottom zone.

4. The inkjet printer according to claim 1, wherein, in the calculation process, the controller calculates the signal level difference between one of an average value and a maximum value of the plurality of first detection signals in each of a plurality of mountain peak zones and one of an average value and a minimum value of the plurality of first detection signals in each of a plurality of the valley bottom zones.

5. The inkjet printer according to claim 1, wherein the line feed width according to the second condition is larger than the line feed width according to the first condition.

6. The inkjet printer according to claim 5, wherein the corrugation forming mechanism is configured to form the sheet to have the corrugation shape at a corrugation forming position which is on an upstream side with respect to the printing head in the conveying direction, and wherein, in the conveying process, the line feed width after a trailing end of the sheet, which is an upstream side end in the conveying direction, has passed the corrugation forming position is larger than the line feed width before the trailing end of the sheet passes the corrugation forming position.

7. The inkjet printer according to claim 1, wherein the storage is configured to store mountain peak ejection timings at which the ink drops to reach the plurality of mountain peak positions are to be ejected and valley bottom ejection timings at which the ink drops to reach the plurality of valley bottom positions are to be ejected, wherein the ejection process includes a compensation process in which the controller compensates for the mountain peak ejection timings and the valley bottom ejection timings, wherein, in the compensation process, the controller:

latens the mountain peak ejection timings according to the first condition in comparison with the mountain peak ejection timings according to the second condition; and expedites the valley bottom ejection timings according to the first condition in comparison with the valley bottom ejection timings according to the second condition.

8. The inkjet printer according to claim 7, wherein the corrugation forming mechanism is configured to for the sheet to have the corrugation shape at a corrugation forming position at an upstream side, in the conveying direction, with respect to the printing head, wherein, in the compensation process, the controller:

expedites the mountain peak ejection timings after a trailing end, which is an upstream side end in the conveying direction, of the sheet has passed the corrugation forming position in comparison with the mountain peak ejection timings before the trailing end of the sheet passes the corrugation forming position; and latens the valley bottom ejection timings after the trailing end of the sheet has passed the corrugation forming position in comparison with the valley bottom ejection timings before the trailing end of the sheet passes the corrugation forming position.

* * * * *